US005485173A

United States Patent [19]

Scheffer et al.

[11] Patent Number: 5,485,173

[45] **Date of Patent: * Jan. 16, 1996**

[54] LCD ADDRESSING SYSTEM AND METHOD

[75] Inventors: Terry J. Scheffer, Portland; Benjamin R. Clifton, Beaverton, both of Oreg.

[73] Assignee: In Focus Systems, Inc., Wilsonville, Oreg.

[ * ] Notice: The portion of the term of this patent subsequent to May 30, 2012, has been disclaimed.

[21] Appl. No.: 678,736

[22] Filed: Apr. 1, 1991

[51] Int. Cl.[6] ..... G09G 3/36

[52] U.S. Cl. ..... 345/100; 345/87

[58] Field of Search ..... 340/784, 784 D, 340/805; 359/55, 58; 345/87, 94, 98, 100

[56] References Cited

U.S. PATENT DOCUMENTS

| | | | |
|---|---|---|---|
| 3,668,639 | 6/1972 | Harmuth | 345/6 |
| 4,127,848 | 11/1978 | Shanks | 340/805 |
| 4,203,104 | 5/1980 | Kmetz | 340/784 |
| 4,250,503 | 2/1981 | Shanks | 340/754 |
| 4,317,115 | 2/1982 | Kawakami et al. | 359/55 |
| 4,346,378 | 8/1982 | Shanks | 340/754 |
| 4,380,008 | 4/1983 | Kawakami et al. | 359/55 |
| 4,506,955 | 3/1985 | Kmetz | 340/802 |
| 4,630,122 | 12/1986 | Morokawa | 359/55 |
| 4,800,382 | 1/1989 | Okanda et al. | 340/805 |

FOREIGN PATENT DOCUMENTS

| | | |
|---|---|---|
| 620036 | 1/1978 | Switzerland . |
| 645473 | 9/1984 | Switzerland . |

OTHER PUBLICATIONS

"Orthogonal Transform Coding System for Television Signals" Hajime Enomoto, Proc. 1971, Walsh Function Symposium, pp. 11–17, AD 720–000.

"Controlled Phase Trasparencies in Coherent–Optical Systems Performing Walsh and Hilbert Transformations" A. A. Vasiléu, 1978 American Institute Physics.

"A Generalized Concept of Frequency and Some Applications" IEEE Transaction on Information Thory, vol. IT–14 No. 3, May 1968.

"Optical Pattern Processing Utilizing Nematic Liquid Crystals" Seiji Inokuchi, Oct. 1972, vo. 11 No. 10, Applied Optics.

"Applications of Walsh Functions" 1973 Proceedings, Apr. 16–18, Symposium, The Catholic University of Americ, Washington, D.C. Henning F. Harmuth.

*Primary Examiner*—Richard Hjerpe
*Assistant Examiner*—Amare Mengistu
*Attorney, Agent, or Firm*—Stoel Rives

[57] ABSTRACT

An addressing method and apparatus addresses faster responding liquid crystal display panels (LCDs) so that video rate, high information content LCDs having time constants on the order of 50 ms or less are perceived as having improved contrast by limiting peak voltage levels across the pixels. In a preferred embodiment, a first set of LCD electrodes is continuously driven with signals each comprising a train of pulses that are periodic in time, have a common period T, are independent of the information to be displayed, and are preferably orthonormal. Plural column signals are generated from the collective information states of the pixels defined by the overlap with a second electrode pattern. Each column signal is proportional to the sum, obtained by considering each pixel in the column, of the exclusive-or (XOR) products of the logic level of the amplitude of each row signal times the logic level of the information state of the pixel corresponding to that row. Hardware implementation comprises an external video source, a controller that receives and formats video data and timing information, a storage device that stores display data, a row signal generator, a column signal generator, and at least one LCD panel. Alternative embodiments provide circuits to reduce the number of column voltage levels required to generate a displayed image.

79 Claims, 21 Drawing Sheets

40

| | | |

42

$$\begin{bmatrix} W_{0;0} & W_{0;1} & W_{0;2} & \cdots & W_{0;2^s-1} \\ W_{1;0} & W_{1;1} & \cdots & \cdots & \cdots \\ W_{2;0} & \cdots & \cdots & \cdots & \cdots \\ \cdots & \cdots & \cdots & \cdots & \cdots \\ \cdots & \cdots & \cdots & \cdots & \cdots \\ W_{2^s-1;0} & \cdots & \cdots & \cdots & W_{2^s-1;2^s-1} \end{bmatrix}$$

LCD ADDRESSING SYSTEM AND METHOD

BACKGROUND OF THE INVENTION

1. Field of the Invention

The present invention pertains to a method and apparatus for addressing liquid crystal devices. More particularly the present invention pertains to a method and apparatus for addressing high information content, direct multiplexed, rms responding liquid crystal displays.

2. Discussion of the Prior Art

Examples of high information content direct multiplexed, rms-responding liquid crystal displays are systems that incorporate twisted nematic (TN), supertwisted nematic (STN), or superhomeotropic (SH) liquid crystal display (LCD) panels. In such panels, a nematic liquid crystal material is disposed between parallel-spaced, opposing glass plates or substrates. In one common embodiment, a matrix of transparent electrodes is applied to the inner surface of each plate, typically arranged in horizontal rows on one plate and vertical columns on the other plate to provide a picture element or "pixel" wherever a row electrode overlaps a column electrode.

High information content displays, such as those used in computer monitors, require large numbers of pixels to portray arbitrary information patterns in the form of text or graphic images. Matrix LCDs having 480 rows and 640 columns forming 307,200 pixels are commonplace, although it is expected that matrix LCDs may soon comprise several million pixels.

The optical state of a pixel, e.g. whether it will appear dark, bright or an intermediate shade, is determined by the orientation of the liquid crystal director within that pixel. In so-called rms responding displays, the direction of orientation can be changed by the application of an electric field across the pixel which field induces a dielectric torque on the director that is proportional to the square of the applied electric field. The applied electric field can be either a dc field or an ac field, and because of the square dependence, the sign of the torque does not change when the electric field changes sign. In the direct multiplexed addressing techniques typically used with matrix LCDs, the pixel sees an ac field which is proportional to the difference in voltages applied to the electrodes on the opposite sides of the pixel. Signals of appropriate frequency, phase and amplitude, determined by the information to be displayed, are applied to the row and column electrodes creating an ac electric field across each pixel which field places it in an optical state representative of the information to be displayed.

Liquid crystal panels have an inherent time constant $\tau$ which characterizes the time required for the liquid crystal director to return to its equilibrium state after it has been displaced away from it by an external torque. The time constant $\tau$ is defined by $\tau=\eta d^2/K$, where $\eta$ is an average viscosity of the liquid crystal, d is the cell gap spacing or pitch length and K is an average elastic constant of the liquid crystal. For a conventional liquid crystal material in a 7–10 μm cell gap, typical for displays, the time constant $\tau$ is on the order of 200–400 ms.

If the time constant $\tau$ is long compared to the longest period of the ac voltage applied across the pixel, then the liquid crystal director is unable to respond to the instantaneous dielectric torques applied to it, and can respond only to a time-averaged torque. Since the instantaneous torque is proportional to the square of the electric field, the time-averaged torque is proportional to the time average of the electric field squared. Under these conditions the optical state of the pixel is determined by the root-mean-square or rms value of the applied voltage. This is the case in typical multiplexed displays where the liquid crystal panel time constant $\tau$ is 200–400 ms and the information is refreshed at a 60 Hz rate, corresponding to a frame period of 1/60 s or 16.7 ms.

One of the main disadvantages of conventional direct multiplex addressing schemes for high information content LCDs arises when the liquid crystal panel has a time constant approaching that of the frame period. (The frame period is approximately 16.7 ms). Recent technological improvements have decreased liquid crystal panel time constants ($\tau$) from approximately 200–400 ms to below 50 ms by making the gap (d) between the substrates thinner and by the synthesis of liquid crystal material which has lower viscosities ($\eta$) and higher elastic constants (K). If it is attempted to use conventional addressing methods for high information content displays with these faster-responding liquid crystal panels, display brightness and contrast ratio are degraded and in the case of SH displays, alignment instabilities are also introduced.

The decrease in display brightness and contrast ratio occurs in these faster panels because with conventional multiplexing schemes for high information content LCDs, each pixel is subjected to a short duration "selection" pulse that occurs once per frame period and has a peak amplitude that is typically 7–13 times higher than the rms voltage averaged over the frame period. Because of the shorter time constant $\tau$, the liquid crystal director instantaneously responds to this high-amplitude selection pulse resulting in a transient change in the pixel brightness, before returning to a quiescent state corresponding to the much lower rms voltage over the remainder of the frame period. Because the human eye tends to average out the brightness transients to a perceived level, the bright state appears darker and the dark state appears brighter. The degradation is referred to as "frame response". As the difference between a bright state and a dark state is reduced, the contrast ratio, the ratio of the transmitted luminance of a bright state to the transmitted luminance of a dark state, is also reduced.

Several approaches have been attempted to reduce frame response. Decreasing the frame period is one approach, but this approach is restricted by the upper frequency limit of the driver circuitry and the filtering effects on the drive waveforms caused by the electrode sheet resistance and the liquid crystal capacitance. Another approach is to decrease the relative amplitude of the selection pulse, i.e., decreasing the bias ratio, but this ultimately reduces the contrast ratio.

Other matrix addressing techniques are known which do not employ high-amplitude row selection pulses and therefore would not be expected to induce frame response in faster-responding panels. However, these techniques are applicable only to low information content LCDs where either there are just a few matrix rows or where the possible information patterns are somehow restricted, such as in allowing only one "off" pixel per column.

One advantage of the faster responding liquid crystal panels is that it makes video rate, high information content LCDs feasible for flat, "hang on the wall" TV screens. However, this advantage cannot be fully exploited with conventional direct multiplexing addressing schemes because of the degradation of brightness and contrast ratio and the introduction of alignment instabilities in these panels caused by frame response.

SUMMARY OF THE INVENTION

In accordance with the present invention, a novel addressing method and several preferred embodiments of an apparatus for addressing faster-responding, high-information content LCD panels are provided. The present addressing method and preferred embodiments provide a bright, high contrast, high information content, video rate display that is also free of alignment instabilities.

In the method of the present invention, the row electrodes of the matrix are continuously driven with row signals each comprising a train of pulses. The row signals are periodic in time and have a common period T which corresponds to the frame period. The row signals are independent of the information or data to be displayed and are preferably orthogonal and normalized, i.e., orthonormal. The term normalized denotes that all the row signals have the same rms amplitude integrated over the frame period while the term orthogonal denotes that if the amplitude of a signal applied to one row electrode is multiplied by the amplitude of a signal applied to another row electrode, then the integral of this product over the frame period is zero.

During each frame period T, multiple column signals are generated from the collective information state of the pixels in the columns. The pixels display arbitrary information patterns that correspond to pixel input data. The column voltage at any time t during frame period T is proportional to the sum obtained by considering each pixel in the column and adding the voltage of that pixel's row at time t to the sum if the pixel is to be "off" and subtracting the voltage of the row of that pixel at time t from the sum if the pixel is to be "on". If the orthonormal row functions switch between only two voltage levels, the above sum may be represented as the sum of the exclusive-or (XOR) products of the logic level of each row signal at time t times the logic level of the information state of the pixel corresponding to that row.

When LCDs are addressed in the method of the present invention, frame response is drastically reduced because the ratio of the peak amplitude to the rms amplitude seen by each pixel is in the range of 2–5 which is much lower than with conventional multiplexing addressing schemes for high information content LCDs. For LCD panels that have time constants on the order of 50 ms, the pixels are perceived as having brighter bright states and darker dark states, and hence a higher contrast ratio. Alignment instabilities that are introduced by high peak amplitude signals are also eliminated.

Hardware implementation of the addressing method of the present invention comprises an external video source, a controller that receives and formats video data and timing information, a storage means for storing the display data, a row signal generator, a column signal generator, and at least one LCD panel.

The addressing method of the present invention may be extended to provide gray scale shading, where the information state of each pixel is no longer simply "on" or "off" but a multi-bit representation corresponding to the shade of the pixel. In this method each bit is used to generate a separate column signal, and the final optical state of the pixel is determined from a weighted average of the effect of each bit of the information state of the pixel.

BRIEF DESCRIPTION OF THE DRAWINGS

FIG. 3 is an example of a 32×32 Walsh function matrix utilized in connection with the invention of FIG. 1.

DESCRIPTION OF THE PREFERRED EMBODIMENTS

Figure 1:
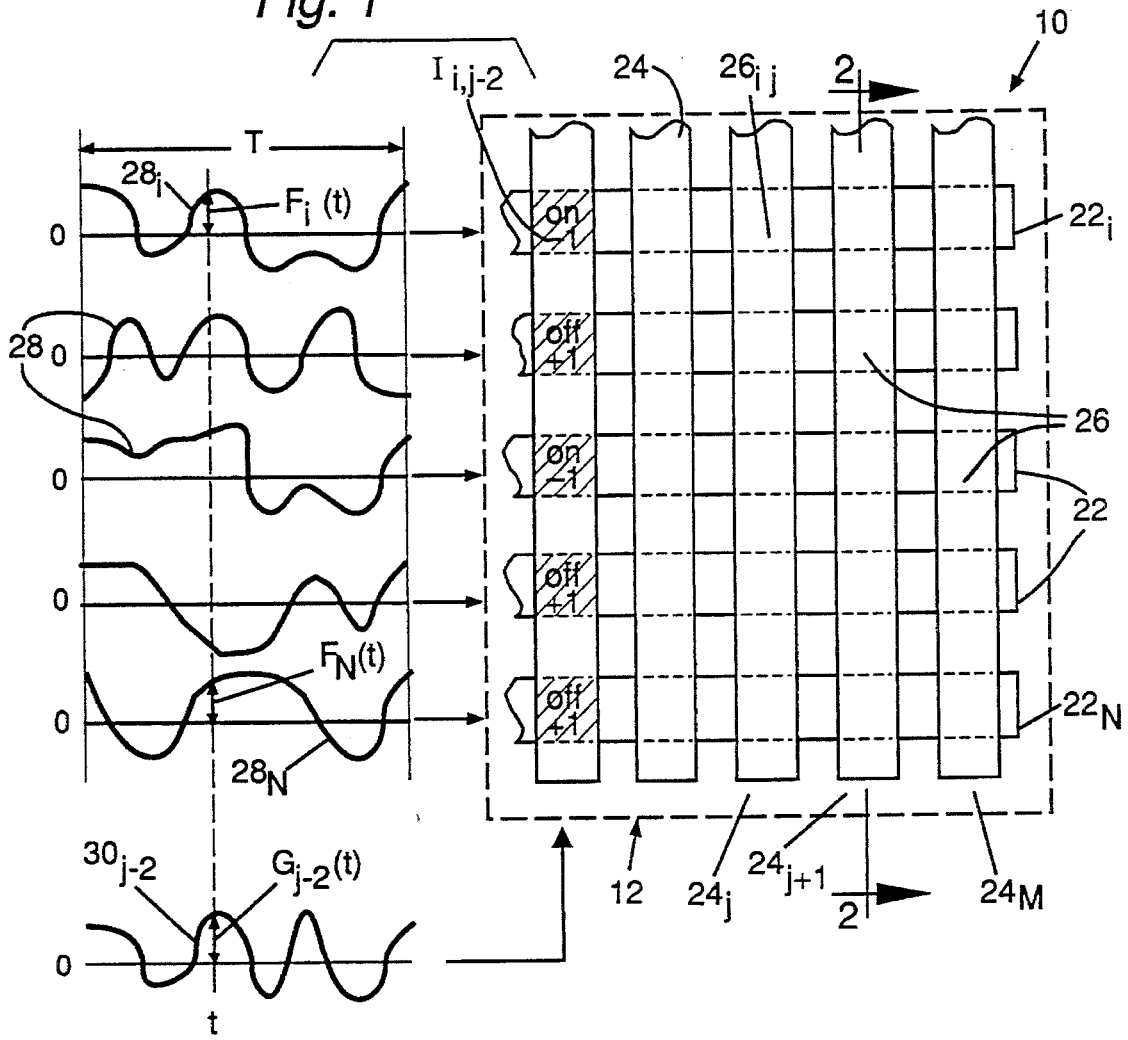
FIG. 1 is a diagramatic view representing row and column addressing signals being applied to a LCD matrix in a display system according to this invention.

According to the principles of the present invention, a new addressing method for high information content, rms responding display systems is provided. In the addressing method of the present invention, the ratio of the magnitude of the peak voltage across an individual pixel during a frame period to the rms voltage averaged over one frame period is substantially lower than conventional addressing methods for high information content displays. In this way, the present addressing method improves display brightness and contrast ratio especially for displays using liquid crystal panels having time constants ($\tau$) below 200 ms. Further, the addressing method eliminates the potentially damaging net dc component across the liquid crystal when averaged over a complete frame period so the displayed image may be advantageously changed every frame period. Still further, the present invention eliminates the occurrence of alignment instabilities.

Reference is now made to the drawings wherein like parts are shown with like reference characters throughout.

Figure 2:
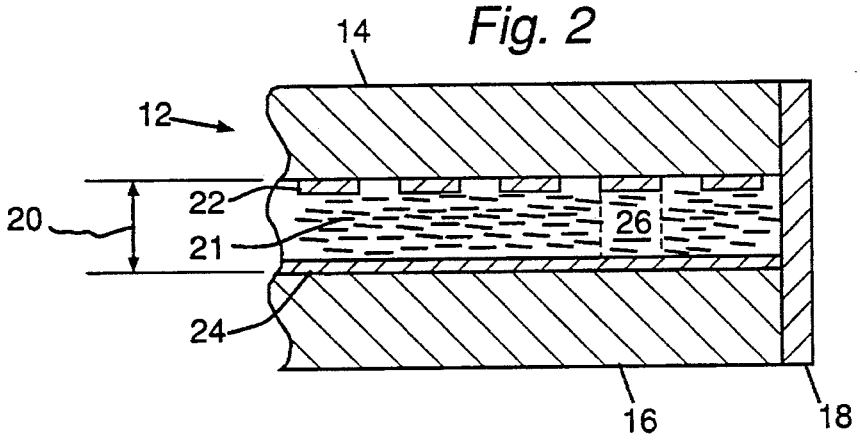
FIG. 2 is a partial cross-sectional view of the LCD matrix taken along line 2—2.

The addressing method may be best described in conjunction with a rms responding liquid crystal display (LCD) depicted in FIGS. 1 and 2. A display system 10 is shown having a LCD display 12 preferably comprising a pair of closely spaced parallel glass plates 14 and 16, most clearly shown in FIG. 2. A seal 18 is placed around the plates 14 and 16 to create an enclosed cell having a gap 20 where gap 20 has a dimension (d) of between 4 μm and 10 μm, although both thinner and thicker cell gaps are known. Nematic liquid crystal material, illustrated at 21, is disposed in cell gap 20.

An N×M matrix of transparent conductive lines or electrodes is applied to the inner surfaces of plates 14 and 16. For illustration purposes, the horizontal electrodes shall be referred to generally as row electrodes $\mathbf{22}_1$–$\mathbf{22}_N$ and the vertical electrodes as column electrodes $\mathbf{24}_1$–$\mathbf{24}_M$. In some instances, it will be necessary to refer to one or two specific electrodes. In those instances, a row electrode will be referred to as the $i^{th}$ electrode of the N row electrodes in the N×M matrix, e.g. $\mathbf{22}_i$, where i=1 to N. Similarly, specific column electrodes will be referred to as the $j^{th}$ electrode of M column electrodes where j=1 to M. The same nomenclature will also be used to refer to some other matrix elements discussed below.

The electrode pattern shown in FIG. 1 comprises hundreds of rows and columns, and wherever a row and column electrode $\mathbf{22}_1$–$\mathbf{22}_N$ and $\mathbf{24}_1$–$\mathbf{24}_N$ overlap, for example where row electrode $\mathbf{22}_i$ overlaps column electrode $\mathbf{24}_j$, a pixel $\mathbf{26}_{ij}$ is formed. It should be apparent that other electrode patterns are possible that may advantageously use the features of the addressing method to be described. By way of example, the electrodes may be arranged in a spiral pattern on one plate and in a radial pattern on the other plate, or, alternatively, they may be arranged as segments of an alpha-numeric display.

Each row electrode $\mathbf{22}_1$–$\mathbf{22}_N$ of display 12 is driven with a periodic time-dependent row signals $\mathbf{28}_1$–$\mathbf{28}_N$, each having a common period T, known as the frame period. In the mathematical equations that follow, the amplitude of row signal $\mathbf{28}_i$ is referred to as $F_i(t)$. It is a sufficient condition for the addressing method of the present invention that row signals $\mathbf{28}_1$–$\mathbf{28}_N$ be periodic and orthonormal over the frame period T.

The term "orthonormal" is a combination of "orthogonal" and "normal". In mathematical terms, normal refers to the property that row signals $\mathbf{28}_1$–$\mathbf{28}_N$ are normalized so that all have the same rms amplitude. Orthogonal refers to the property that each row signal $\mathbf{28}_i$ when multiplied by a different row signal, $\mathbf{28}_{i\neq}$ for example, results in a signal whose integral over the frame period is zero.

The desired information state of pixels 26 can be represented by an information matrix I whose elements $I_{ij}$ correspond to the state of the pixel defined by the overlap of the $i^{th}$ row electrode with the $j^{th}$ column electrode. If, according to the desired information pattern, pixel $\mathbf{26}_{ij}$ is to be "on", then the pixel state is −1 and $I_{ij}$=−1 (logic HIGH) If pixel $\mathbf{26}_{ij}$ is to be "off", then the pixel state is +1 and $I_{ij}$=+1 (logic LOW). In FIG. 1, for example, the element $I_{ij-2}$ of the information matrix refers to the pixel state of the pixel defined by the $i^{th}$ row and $(j-2)^{th}$ column electrodes. This pixel state is set to a −1 and pixel 26 will be "on". An information vector $I_j$ may also be defined that is the $j^{th}$ column of the information matrix I. For the partial column j−2 illustrated in FIG. 1, the elements $I_{ij}$ of the information vector $I_{j-2}$ are [−1, +1, −1, +1, +1] (for i=N−4 to N).

Each column electrode $\mathbf{24}_1$–$\mathbf{24}_M$ has a column signal, such as, for example, signal $\mathbf{30}_{j-2}$, applied thereto. The amplitude of column signal $\mathbf{30}_{j-2}$ depends upon the information vector $I_{j-2}$ that represents all of the pixels in the column and row signals $\mathbf{28}_1$–$\mathbf{28}_N$. Similarly, the amplitudes of all other column signals $\mathbf{30}_1$–$\mathbf{30}_M$ depend on the corresponding information vector $I_j$ and row signals $\mathbf{28}_1$–$\mathbf{28}_N$. In the mathematical equations that follow, the amplitude of column signal $\mathbf{30}_j$ at time t for the $j^{th}$ column is referred to as $G_{I_j}(t)$ where $I_j$ is the information vector for the $j^{th}$ column.

The voltage across pixel $\mathbf{26}_{ij}$ in the $i^{th}$ row and the $j^{th}$ column, $U_{ij}$, is the difference between the amplitude $F_i(t)$ of the signal applied to row $\mathbf{22}_i$ and the amplitude $G_{I_j}(t)$ of the signal applied to column $\mathbf{24}_j$, that is:

$$U_{ij}(t)=F_i(t)-G_{I_j}(t) \tag{1}$$

The root mean square value of the voltage, (i.e., the rms voltage) appearing across pixel $\mathbf{26}_{ij}$ is:

$$\langle U_{ij}\rangle=\frac{1}{\sqrt{T}}\sqrt{\int_0^T U_{ij}(t)^2dt} \tag{2}$$

Substituting equation 1 into equation 2 yields:

$$\langle U_{ij}\rangle=\frac{1}{\sqrt{T}}\sqrt{\int_0^T F_i(t)^2dt-2\int_0^T F_i(t)G_{I_j}(t)dt+\int_0^T G_{I_j}(t)^2dt} \tag{3}$$

In the method of the present invention, column signals $\mathbf{30}_1$–$\mathbf{30}_M$ are generated as a linear combination of all row signals $\mathbf{28}_1$–$\mathbf{28}_N$ and coefficients of +1 or −1. The coefficients are the pixel states of the pixels in the column. Column signals $\mathbf{30}_1$–$\mathbf{30}_M$ are therefore calculated for each column in the following manner:

$$G_{I_j}(t)=c\sum_{i=1}^{N} I_{ij}F_i(t), \tag{4}$$

where the $I_{ij}$ is the information state of the pixel in the $j^{th}$ column at the $i^{th}$ row and c is a constant of proportionality.

Substituting equation 4 into equation 3 and assuming that row signals $\mathbf{28}_1$–$\mathbf{28}_N$ are orthonormal, i.e., $$\frac{1}{\sqrt{T}}\sqrt{\int_0^T F_p(t)F_q(t)dt}=\begin{cases}\overline{F} \text{ if } p=q\\ 0 \text{ if } p\neq q,\end{cases} \tag{5}$$

provides:

$$\langle U_{ij}\rangle=\overline{F}\sqrt{1-2cI_{ij}+Nc^2} \tag{6}$$

For an "on" pixel, $I_{ij}$=−1 and the "on" rms voltage across the pixel is therefore:

$$\langle U_{on}\rangle=\overline{F}\sqrt{1+2c+Nc^2} \tag{7}$$

For an "off" pixel, $I_{ij}$=+1 and the "off" rms voltage across the pixel is therefore:

$$<U_{off}> = \overline{F}\sqrt{1-2c+Nc^2} \tag{8}$$

The selection ratio R is the ratio of the "on" rms voltage to the "off" rms voltage that can occur across a pixel. That is:

$$R = \frac{<U_{on}>}{<U_{off}>} \tag{9}$$

The maximum selection ratio can be found by substituting equations 7 and 8 into equation 9 and maximizing R with respect to the proportionality constant c. This results in:

$$R_{max} = \sqrt{\frac{\sqrt{N}+1}{\sqrt{N}-1}}, \tag{10}$$

with $$c = \frac{1}{\sqrt{N}} \tag{11}$$

Under some circumstances it may be advantageous to use a different value of c which does not maximize the theoretical selection ratio.

Substituting c from equation 11 into equation 8 and setting $<U_{off}>=1$, i.e., normalizing all voltages with respect to the "off" rms voltage results in $$\overline{F} = \sqrt{\frac{\sqrt{N}}{2(\sqrt{N}-1)}}. \tag{12}$$

Substituting equation 11 into equation 4 gives the expression for the column voltage:

$$G_{I_j}(t) = \frac{1}{\sqrt{N}} \sum_{i=1}^{N} I_{ij}F_i(t), \tag{13}$$

Referring again to FIG. 1, where row signals $\mathbf{28}_1$–$\mathbf{28}_N$ are analog signals that continuously vary in frequency and amplitude, equation 13 may be easily implemented in a variety of hardware embodiments. For example, display system 10 may incorporate a plurality of analog multipliers that multiply the amplitude $F_i(t)$ of each row signal $\mathbf{28}_i$ with the corresponding element of the information matrix $I_{ij}$. An analog summer sums the output of each multiplier to provide a voltage to the corresponding column electrode $\mathbf{24}_1$–$\mathbf{24}_M$.

Those skilled in the art will recognize that a common signal H(t) could be superimposed on all row and column signals $\mathbf{28}_1$–$\mathbf{28}_N$ and $\mathbf{30}_1$–$\mathbf{30}_M$ to alter their outward appearances, but this does not change the principles of the present invention. This is so because, as equation 1 shows and as discussed earlier, it is the voltage difference across a pixel which determines its optical state and this difference is unaffected by superimposing a common signal on all row and column electrodes $\mathbf{22}_1$–$\mathbf{22}_N$ and $\mathbf{24}_1$–$\mathbf{24}_M$.

Walsh Function Matrix Description

The generalized analog row signals $\mathbf{28}_1$–$\mathbf{28}_N$ shown in FIG. 1 could be bilevel signals. Bilevel signals are advantageous because they are particularly easy to generate using standard digital techniques. Walsh functions are one example of bilevel, orthonormal functions that may be used as row addressing signals. Walsh row signals have the form:

$$F_i(t) = \overline{F}\cdot W_{ik} = W_i(\Delta t_k) \tag{14}$$

where the $W_{ik}$ are elements of a $2^s \times 2^s$ Walsh function matrix which are either +1 or −1. The index i corresponds to the $i^{th}$ row of the Walsh matrix as well as to the signal for the $i^{th}$ row of the display. The Walsh matrix columns correspond to a time axis consisting of $2^s$ equal time intervals Δt over the frame period T, and the index k refers the $k^{th}$ time interval $\Delta t_k$ as indicated by the alternate notation in equation 14. The elements of the Walsh matrix are either +1 or −1, so that amplitude $F_i(t)$ assumes one of two values, i.e. either $+\overline{F}$ or $-\overline{F}$ over each of the time intervals $\Delta t_k$.

Column signals $\mathbf{30}_1$–$\mathbf{30}_M$ are obtained by substituting equation 14 into equation 13 to give:

$$G_{I_j}(\Delta t_k) = \frac{\overline{F}}{\sqrt{N}} \sum_{i=1}^{N} I_{ij}\cdot W_{ik} \tag{15}$$

Figures 4, 5:
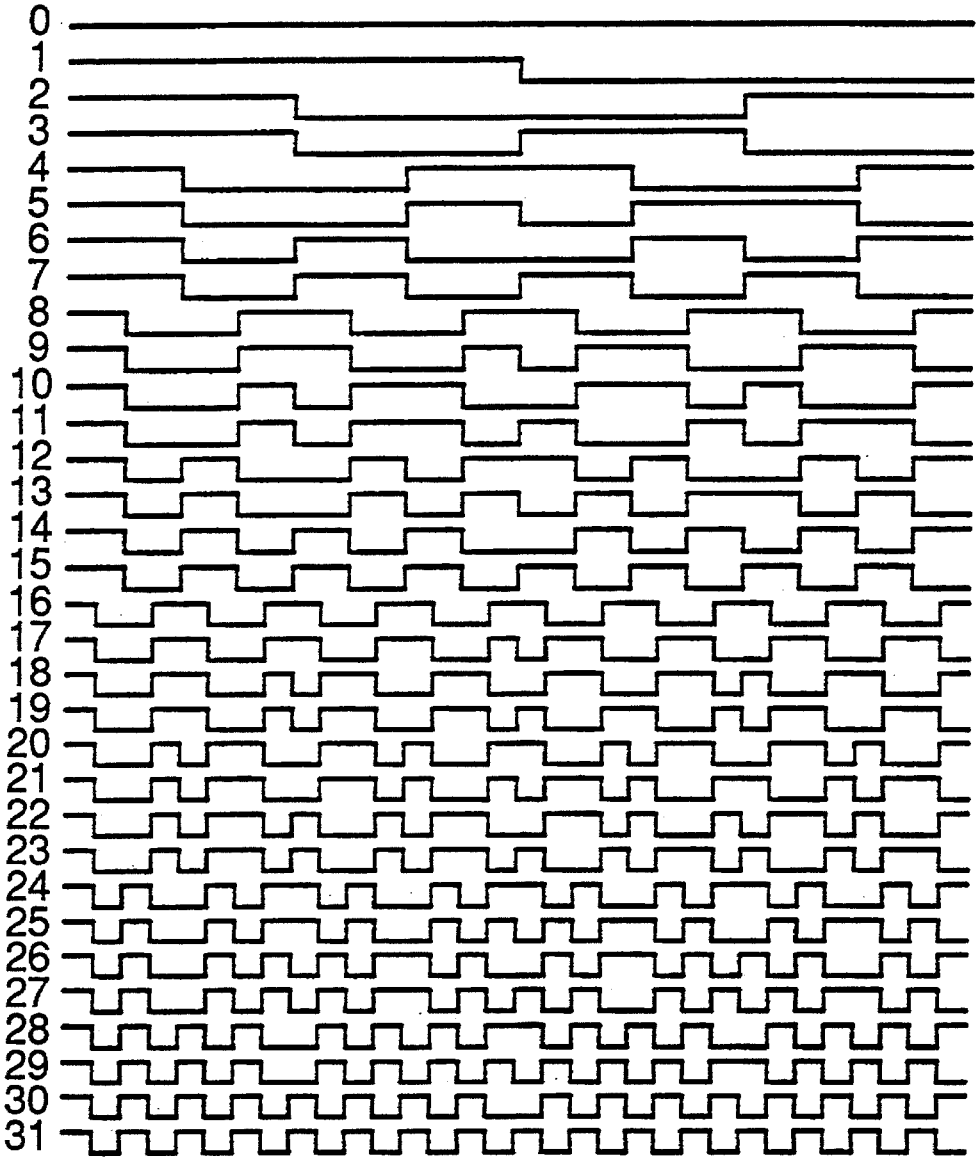
FIG. 4 represents Walsh function waveforms corresponding to the Walsh function matrix of FIG. 3.
FIG. 5 is a generalized form of the Walsh function matrix of FIG. 3.

An example of a 32×32 (s=5) Walsh function matrix 40 is given in FIG. 3 and one period of the Walsh waves derived from corresponding rows of this matrix are shown in FIG. 4. At the end of each period the Walsh waves repeat. In the examples of FIGS. 3 and 4 the Walsh functions have been ordered according to sequency with each succeeding Walsh wave having a sequency of one greater than the preceding Walsh wave. Sequency denotes the number of times each Walsh wave crosses the zero voltage line (or has a transition) during the frame period. The sequency has been noted in FIG. 4 to the left of each Walsh wave.

Walsh functions come in complete sets of $2^s$ functions each having $2^s$ time intervals. If the number of matrix rows N of display 12 is not a power of 2, then row signals $\mathbf{28}_1$–$\mathbf{28}_N$ must be chosen from a Walsh function matrix having an order corresponding to the next higher power of two, that is $2^{s-1}<N\leqq 2^s$. The Walsh matrix must have an equal or greater number of rows than the display because the orthogonality condition prevents the same row signal $\mathbf{28}_i$ from being used more than once. For example, if N=480 (i.e., display 12 has 480 rows designated $\mathbf{22}_1$–$\mathbf{22}_{480}$), 480 different or unique row signals are selected from the set of 512 Walsh functions having 512 time intervals Δt. In this instance, s=9.

It should be apparent that it is possible for display 12 to be configured into several separately addressable screen portions. For example, if a 480 row display 12 were split into two equal portions, each portion of display 12 would be addressed as though it were a 240 row display. In this instance, N=240 and row signals $\mathbf{28}_1$–$\mathbf{28}_N$ are selected from the set of 256 Walsh functions having 256 time intervals At.

The general form of the Walsh function matrix 42 is shown in FIG. 5. The elements $W_{u,v}$ (where u,v=0, 1, 2, . . . $2^{s-1}$) have the sequency ordering described above if each element is defined by the relation:

$$W_{u,v} = (-1)^{\sum_{i=0}^{s-1} r_i(u)\cdot v_i} \tag{16}$$

where subscript i refers to the $i^{th}$ digit of the binary representation of the decimal number u that denotes the row location or v that denotes the column location, i.e., $$u_{decimal} = (u_{s-1}, u_{s-2}, \ldots u_1, u_0)_{binary} \tag{17}$$

and $$v_{decimal} = (v_{s-1}, v_{s-2}, \ldots v_1, v_0)_{binary} \tag{18}$$

where the $u_i$ and $v_i$ are either 0 or 1; and $$r_0(u) = u_{s-1} \tag{19}$$

$$r_1(u) = u_{s-1} + u_{s-2}$$

$$r_2(u) = u_{s-2} + u_{s-3}$$

$$\vdots$$

$$r_{s-1}(u) = u_1 + u_0$$

If the sum in equation 16 is odd, then $w_{u,v}=-1$ and if it is even, then $w_{u,v}=+1$.

By using equations 16–19, any element in matrix 42 may be determined. For example, to determine the element in the $6^{th}$ row and the $4^{th}$ column (i.e., $W_{5,3}$) in a Walsh matrix of order 8 (i.e., s=3), the operations indicated by equations 17 and 18 must be performed. Specifically, since:

$$u_{decimal}=5=(101)_{binary} \tag{20}$$

then:

$$u_2=1,\ u_1=0,\ u_0=1 \tag{21}$$

Similarly, $$v_{decimal}=3=(011)_{binary} \tag{22}$$

and therefore:

$$v_2=0,\ v_1=1,\ v_0=1 \tag{23}$$

Substituting the above values for u as found in equation 21 into the appropriate equations 19 we obtain:

$$r_0(u)=u_2=1$$

$$r_1(u)=u_2+u_2=1+0=1 \tag{24}$$

$$r_2(u)=u_1+u_0=0+1=1$$

Combining equations 23 and 24, we obtain:

$$v_0 \cdot r_0=1 \cdot 1=1$$

$$v_1 \cdot r_1=1 \cdot 1=1 \tag{25}$$

$$v_2 \cdot r_2=0 \cdot 1=0$$

By summing the results (equation 16), it is found that $\Sigma=2$ and $W_{5,3}=(-1)^2=1$.

The remaining elements of the matrix 42 may be determined by performing similar calculations. The above calculations may be performed in real time for each frame period or, preferably, the calculations may be performed once and stored in read-only memory for subsequent use. The Walsh function waves of matrix 42 form a complete set of orthonormal functions having the property:

$$\frac{1}{2^s}\sum_{j=0}^{2^s-1} W_{i,j} \cdot W_{k,j} = \delta_{i,k} \tag{26}$$

where:

$$\delta_{ik} = 1 \text{ if } i = k \qquad \delta_{ik} = 0 \text{ if } i \neq k. \tag{27}$$

Pseudo Random Binary Sequences

Another class of bilevel orthonormal row signals $\mathbf{28}_1$–$\mathbf{28}_N$ may be obtained from a class of functions known as maximal length Pseudo Random Binary Sequences (PRBS) functions.

Figure 6:
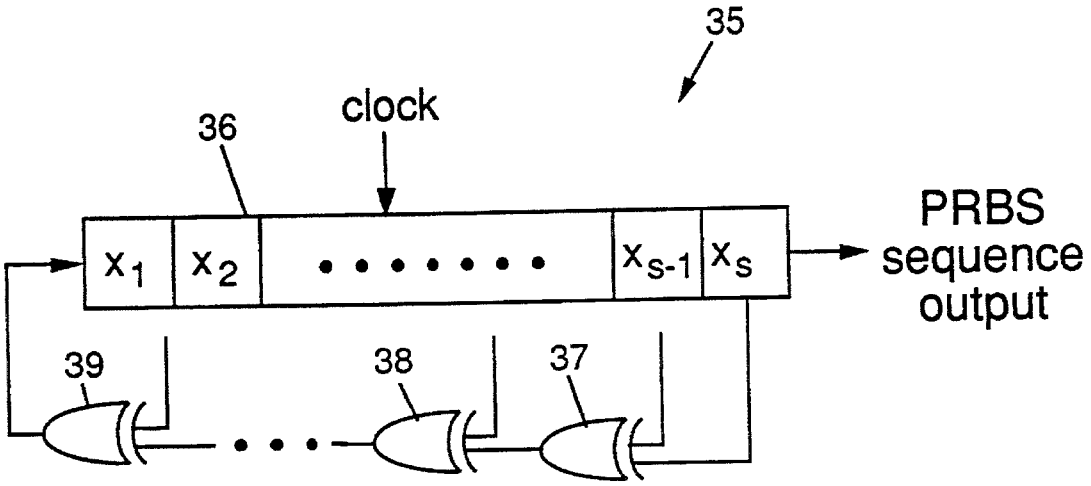
FIG. 6 is a generalized representation of one embodiment of a circuit used to generate a pseudo-random binary sequence in accordance with the present invention.

PRBS functions can be generated from the general shift register circuit 35 having a shift register 36 with exclusive-or feedback gates 37–39 shown in FIG. 6. Such a circuit can be practically implemented as such or it can be used as a model to generate the PRBS functions on a computer with the results stored in a ROM.

Starting with the shift register in some initial logic state designated by $x_1$–$x_s$, clock pulses are applied to the register which successively shift the logic states of the various stages forward to the output stage and feed new logic states back to the input stage as determined by the connections to the exclusive-or gates. After a certain number of clock pulses, the shift register returns to its initial state and the binary sequence at the output stage starts to repeat. The length of the output sequence before it repeats is determined by the number and positions of the stages involved in the feedback loop. For an s-stage register, the maximum length L of the nonrepeating sequence is $L=2^{s-1}$. Examples of feedback connections that generate maximal length sequences are summarized below.

TABLE 1

| shift register stages s | feedback connections at stages | length of sequence $L = 2^s - 1$ |
|---|---|---|
| 2 | 2, 1 | 3 |
| 3 | 3, 1 | 7 |
| 4 | 4, 3 | 15 |
| 5 | 5, 3 | 31 |
| 6 | 6, 5 | 63 |
| 7 | 7, 6 | 127 |
| 8 | 8, 6, 5, 4 | 255 |
| 9 | 9, 5 | 511 |
| 10 | 10, 7 | 1023 |
| 11 | 11, 9 | 2047 |
| 12 | 12, 11, 8, 6 | 4095 |
| 13 | 13, 12, 10, 9 | 8191 |

By considering the logic states as voltage levels, and substituting a +1 for the logic 0 and −1 for the logic 1, the exclusive-or operation is transformed to ordinary multiplication. We will adopt this latter definition of the logic states, as indicated in Table 2, throughout the remainder of this section.

TABLE 2

| input 1 | input 2 | output |
|---|---|---|
| +1 | +1 | +1 |
| +1 | −1 | −1 |
| −1 | +1 | −1 |
| −1 | −1 | +1 |

Consider the simple example of a 3 stage shift register with feedback connections at 3 and 1 as shown in Table 1. Starting from the initial logic state of −1,+1,+1 for the three stages, the subsequent states of the shift register can be determined from the recursive relations:

$$x_1(n+1) = x_3(n)x_1(n) \tag{28}$$

$$x_2(n+1) = x_1(n)$$

$$x_3(n+1) = x_2(n)$$

where $x_i(n)$ is the logic state of the $i^{th}$ stage in the register after application of the $n^{th}$ clock pulse assuming that the register is initialized with the first clock pulse. The state of the shift register after a first and subsequent clock pulses is summarized in Table 3. For this case, the state of the shift register and output binary sequence repeats after 7 cycles, i.e., $x_i(n)=x_i(n+7)$.

TABLE 3

| clock pulse | 1 | 2 | 3 | 4 | 5 | 6 | 7 | 8 | 9 |
|---|---|---|---|---|---|---|---|---|---|
| $x_1$ | −1 | −1 | −1 | +1 | −1 | +1 | +1 | −1 | −1 |
| $x_2$ | +1 | −1 | −1 | −1 | +1 | −1 | +1 | +1 | −1 |
| $x_3$ | +1 | +1 | −1 | −1 | −1 | +1 | −1 | +1 | +1 |

As another example, consider a 255 cycle maximal length PRBS function obtained from the following recursive equations based on an 8 stage shift register. Again, making the feedback connections recommended in Table 1 for s=8 gives:

$$x_1(n+1)=x_8(n)x_6(n)x_5(n)x_4(n) \tag{29}$$
$$x_2(n+1)=x_1(n)$$
$$x_3(n+1)=x_2(n)$$
$$\vdots$$
$$x_8(n+1)=x_7(n)$$

An L×L matrix of PRBS functions may be defined, where the first row is just the PRBS function itself, i.e., $P_{1j}=x_s(j)$, and each subsequent matrix row is derived from the previous one by a cyclical shift of one cycle. Thus, the second row is $P_{2j}=x_s(j+1)$ and the $i^{th}$ row is $P_{ij}=x_s(j+i-1)$. Maximal length PRBS functions are interesting because of the property that they are nearly orthogonal to shifted versions of themselves i.e.

$$\frac{1}{L}\sum_{j=1}^{L} P_{ij}P_{kj}=\begin{cases}1 & \text{if } i=k\\ -1/L & \text{if } i\neq k\end{cases} \tag{30}$$

The expression for the column voltage using PRBS functions is similar to equation 15 for the Walsh functions except that the PRBS matrix elements $P_{ik}$ are substituted for the Walsh matrix elements $W_{ik}$.

Swift Functions

As discussed above, analog row signals $\mathbf{28}_1$–$\mathbf{28}_N$ of FIG. 1 may be implemented using waveforms generated with analog circuit elements. However, if row signals $\mathbf{28}_1$–$\mathbf{28}_N$ are digital representations of Walsh or PRBS functions, hardware implementation of the present addressing method is possible using digital logic. Further, to improve display performance of display system 10, a fourth class of functions may be described which are called "Swift" functions. Swift functions may be derived, for example, from the Walsh functions or from the PRBS functions.

Swift functions based on Walsh functions:

A Swift matrix may be derived from Walsh matrix 42 by selecting N rows. Preferably the selected rows are derived from the set of sequence-ordered Walsh waves having the highest sequency.

One advantage of using the higher sequency rows is that the first row of Walsh matrix 42 need not be used. The first row is unique in that it is always +1 while all other rows have an equal number of positive amplitude and negative amplitude time intervals. Eliminating the first row eliminates the potentially damaging net dc component across the pixels of display 12 when the pixel voltage is averaged over a frame period. The average net dc component across a pixel is determined from the difference between the column voltage amplitude $G_I(t)$ and the row voltage amplitude $F_i(t)$ averaged over all the time intervals Δt of the period.

Since there is no potentially damaging net dc component when Swift waveforms $S_i$ are used, it is not necessary to invert row and column signals $\mathbf{28}_1$–$\mathbf{28}_N$ and $\mathbf{30}_1$–$\mathbf{30}_M$ after every frame period. Further, with the present invention, display information may be advantageously changed after every frame period.

The Swift matrix may be further modified by randomly inverting a portion of the N rows in the Swift matrix. Inversion is accomplished by multiplying each element in the selected row by −1. In one preferred embodiment, a selected percentage that is preferably between 40% and 60% (e.g., 50%) of the rows in the Swift matrix is inverted. Thus for any time interval about half the rows receive a voltage of $+\overline{F}$ and the remaining rows receive a voltage of $-\overline{F}$. For other time intervals, this proportion stays about the same except that different rows are selected for the $+\overline{F}$ and $-\overline{F}$ voltages.

Inverting the Swift waves in this way affects neither the orthogonal or normal property but eliminates the possibility that certain common information patterns would occur if, for example, stripes or checker-boards of various widths were displayed. Such common information patterns might produce an unusually high or low number of matches between information vector $I_j$ and the Swift function vector, and hence a large $G_{I_j}$ voltage for certain time intervals.

The Swift matrix could also be modified by reordering the rows. This does not affect the orthonormal property, and under some circumstances could be used to reduce display streaking effects. In another embodiment, a selected proportion of less than 75% (e.g., a proportion of 50%) of the row signals has the same amplitude for any given time interval.

Swift functions based on maximal length PRBS:

Although maximal length PRBS functions are nearly orthogonal for large L, they still would induce crosstalk if used in this form for the matrix addressing of the present invention. To obtain theoretically orthogonal functions from the maximal length PRBS functions, a new set of Swift functions is created by adding an extra time interval to the PRBS functions and forcing the value of the Swift function to always be either +1 or −1 during this interval, i.e., $P_{i(L+1)}=+1$ or −1. The resulting pulse sequence now has exactly $2^s$ time intervals with the desired orthonormal properties:

$$\frac{1}{2^s}\sum_{j=1}^{2^s} P_{ij}P_{kj}=\begin{cases}1 \text{ if } i=k\\ 0 \text{ if } i\neq k\end{cases} \tag{31}$$

It is preferable to choose $P_{i(L+1)}=+1$ in order to ensure that the functions will have no net dc value, i.e.

$$\sum_{j=1}^{(L+1)} P_{ij}=0. \tag{32}$$

Displays addressed with these Swift functions seem to give a more uniform appearance than displays addressed with Swift functions based on Walsh functions. This is so because the PRBS functions all have the same frequency content, and therefore the attenuation of the row waveforms by the RC load of the display is substantially the same for all rows.

In a similar manner to the Swift functions based on Walsh functions, preferably, about half of the rows of the present Swift matrix are inverted by multiplying these rows by −1.

Swift functions based on other orthonormal bilevel functions:

One skilled in the art will recognize that there is practically a limitless number of orthonormal bilevel functions that could be used for Swift functions. For example the Swift functions based on Walsh functions described above could be transformed into a completely different set of Swift functions simply by interchanging an arbitrary number of columns in the Swift matrix, a procedure which does not affect the orthonormal property. Of course the same holds true for the Swift functions based on maximal length PRBS functions. Swift functions could also be transformed by inverting an arbitrary number of columns, i.e. by multiplying them by −1. But this procedure would be less desirable because, even though the orthonormal property would be retained, this transformation generally would introduce a net dc voltage across the pixel which would necessitate inverting all drive levels every other frame period to remove it.

The expression for the column voltage using Swift functions is similar to equation 15 derived for the Walsh functions except that the Swift matrix elements $S_{ik}$ are substituted for the Walsh matrix elements $W_{ik}$.

Amplitude of the Column Signals:

Examination of the sum in equation 15 reveals that for any given time interval $\Delta t_k$, the amplitude $G_{I_j}(t)$ of column signal $\mathbf{30}_j$ is dependent upon the magnitude of the summation. The sum is the number of times an element in information vector $I_j$ matches an element in the Swift column vector $S_k$ (i.e., +1 matches +1 or −1 matches −1) minus the number of times there are mismatches (i.e., +1 and −1 or −1 and +1). Since the total number of matches and mismatches must add up to N, equation 15 becomes:

$$G_I(\Delta t_k) = \frac{\overline{F}}{\sqrt{N}}\,(2D_k - N), \tag{33}$$

where $D_k$ is the number of matches between information vector $I_j$ and the $k^{th}$ column of the Walsh, Swift or PRBS function matrix. Thus the column voltage can be as large as $+\sqrt{N}\cdot\overline{F}$ or as small as $-\sqrt{N}\cdot\overline{F}$ depending upon whether there are N matches or zero matches. However, assuming that signs of the column elements in the matrix $S_{ik}$ are randomly distributed, as is true in the Swift matrix, the probability of all elements of information vector $I_j$ exactly matching or exactly mismatching the Swift matrix column $S_k$ is very low, especially when the number of rows N of display 12 is large, as is the case for a high information content display. The matching probability for certain Walsh matrix columns could be significantly higher for certain information patterns, and this is one reason why the use of a Swift function matrix is preferred.

The probability of D matches occurring P(D) can be expressed as $$P(D) = \left[\frac{\binom{N}{D}}{2^N}\right] \text{ where } \binom{N}{D} \tag{34}$$

is the binomial coefficient giving the number of combinations of N distinct things taken D at a time, and is defined by:

$$\binom{N}{D} = \frac{N!}{(N-D)!\cdot D!} \tag{35}$$

For large N and D, the binomial distribution may be approximated by the normal distribution. Thus, equation 34 becomes:

$$P(D) = \sqrt{\frac{2}{\pi N}}\,\exp\left[\frac{-(2D-N)^2}{2N}\right] \tag{36}$$

It is clear from equation 36 that the most probable number of matches will occur for D=N/2 for which, referring to equation 33, the column voltage is zero. The more D deviates from the most probable value of N/2, the larger the magnitude of the column voltage, but this condition becomes less and less likely to occur. The largest column voltage that will occur, on the average, over one complete frame period (i.e., considering every time interval $\Delta t_k$ where $1 \leqq k \leqq 2^s$) can be obtained by solving equation 36 for the value of D' where $P(D')=2^{-s}$ and substituting this value into equation 33. The resultant most probable peak column signal voltage magnitude that will occur over a complete frame period, $G_{peak}$, is then given by $$G_{peak} = \overline{F}\sqrt{(2s+1)\ln(2) - \ln(\pi N)} \tag{37}$$

Since the voltage across the pixel is the difference between the row and column voltages (equation 1), the magnitude of the maximum voltage occurring across a pixel $U_{peak}$ is:

$$U_{peak} = \overline{F}[1 + \sqrt{(2s+1)\ln(2) - \ln\pi N}\,] \tag{38}$$

which is also the ratio of the magnitude of the peak voltage occurring during a frame period to the "off" rms voltage since $\langle U_{off}\rangle$ has been normalized, i.e., $\langle U_{off}\rangle=1$. It is desirable that $U_{peak}$ be as close to $\langle U_{off}\rangle$ as possible to minimize the effect of "frame response". By way of example, for a display having 240 multiplexed rows (N=240) s=8 and from equations 12 and 38, $U_{peak}/\langle U_{off}\rangle=$ 2.39. Over many frame periods T, higher peak voltages are likely to occur. However, it is very unlikely that the ratio of $U_{peak}/\langle U_{off}\rangle$ will exceed 5:1. This ratio is dramatically lower than the value of 12.06 which results from the conventional addressing method for high information content LCDs.

Figure 7:
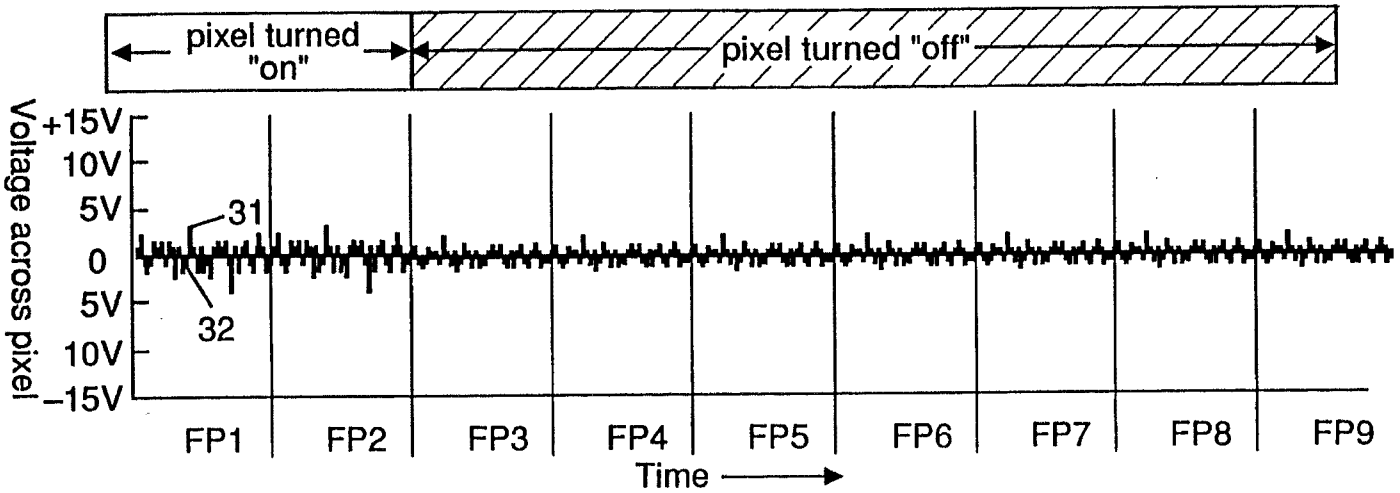
FIG. 7 shows a voltage waveform across a pixel for several frame periods according to the addressing method of the present invention.
Figure 8:
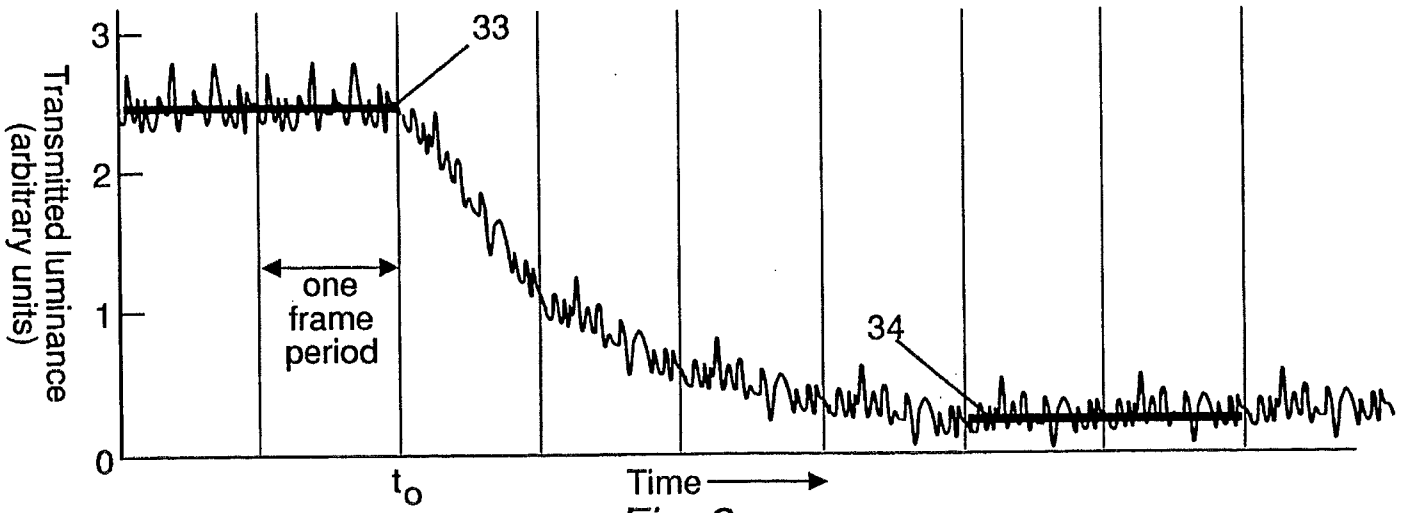
FIG. 8 represents the optical response of a pixel to the voltage waveform of FIG. 7.

Optical Response to Swift Function Drive:

Referring now to FIGS. 7 and 8, a typical waveform $U_{ij}(t)$ across a pixel, such as pixel $\mathbf{26}_{ij}$, of FIG. 1, is shown for several frame periods T for the case of Swift function drive where display 12 is a STN display. Waveform $U_{ij}(t)$ comprises a plurality of substantially low amplitude pulses such as pulses 31 and 32 that occur throughout the frame period. By providing the pixels with a plurality of low amplitude pulses throughout the entire frame period, frame response is substantially avoided. The resulting improvement in brightness and contrast ratio is especially noticeable for displays 12 having time constants below 200 ms.

FIG. 8 represents the optical response of pixel $\mathbf{26}_{ij}$ to waveform $U_{ij}(t)$. As shown by the superimposed designators 33 and 34, the transmitted luminance is relatively constant during frame periods FP1 and FP2 when pixel $\mathbf{26}_{ij}$ is in the "on" state and frame periods FP7 and FP8 when the pixel $\mathbf{26}_{ij}$ is in the "off" state. During frame periods FP1 and FP2, the transmitted luminance of pixel $\mathbf{26}_{ij}$ appears bright to an observer because the relatively constant luminance is the result of reduced frame response. Similarly, during frame periods FP7 and FP8, pixel $\mathbf{26}_{ij}$ appears darker than would a pixel exhibiting greater frame response.

Number of Levels Required for Column Signals:

From equation 33 it is seen that, for each time interval, $G_{I_j}(\Delta t)$ assumes a discrete voltage level determined by the total number of matches, D, between corresponding elements in information vector $I_j$ and the Swift function vector. Since D generally can take any integral value between 0 and N, then there will be a maximum of N+1 possible voltage levels. However according to equations 34 and 36, not all values of D are equally probable, and more particularly values of D near N/2 are much more likely to occur than values of D near the extremes of 0 or N. Thus the actual number of levels required to practically implement the addressing method of the present invention is considerably fewer than N+1. The minimum number of levels required would be those levels which, on the average, occur at least once during the frame period, i.e. after information vector $I_j$ has been compared with all $2^s$ Swift vectors of the frame period. The average number of times that D matches will occur during one frame period, F(D), is determined by multiplying the $2^s$ time intervals of the frame period by the probability function P(D) of equation 34 or 36. Thus the values of D that will occur at least once during the frame period are those values of D which satisfy the condition:

$$F(D)=2^s P(D)>1 \tag{39}$$

Adding the number of different values of D that satisfy this condition gives the minimum number of voltage levels required. Making use of equation 36 results in:

$$\text{Minimum number of levels} = \sqrt{N}\ \sqrt{(2s+1)\ln(2)-\ln(\pi N)} \tag{40}$$

Substituting known values into equation 40 shows that only a small fraction of the maximum possible number of levels are actually needed for the addressing scheme of the present invention. For example, substituting N=240 and s=8 into equation 40 results in a minimum of 35 levels. This lies considerably below the maximum possible number of 241 levels.

Figure 9:
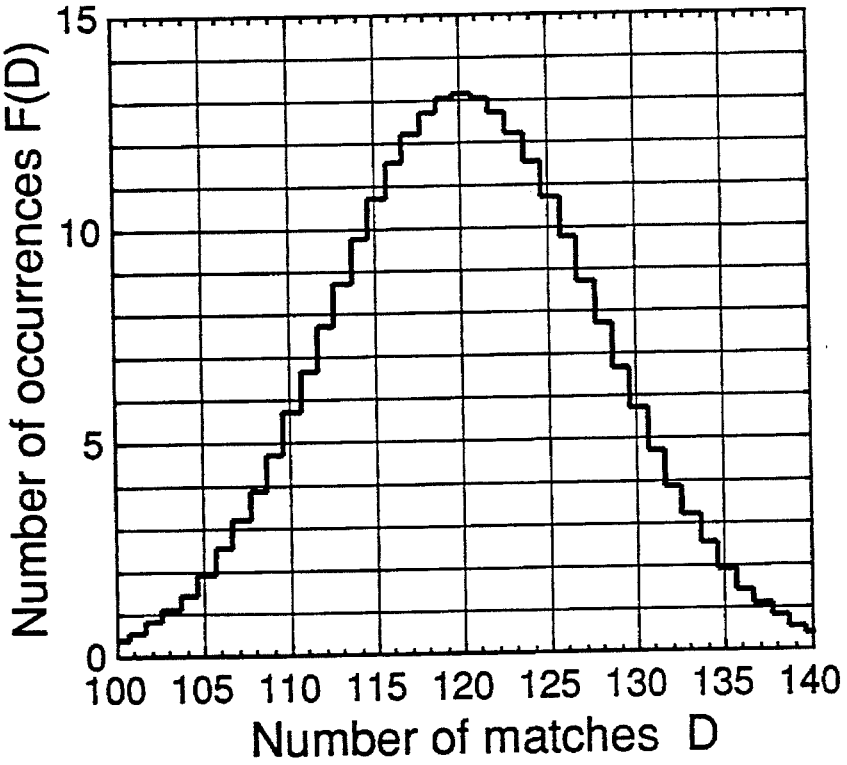
FIG. 9 is a graph depicting the number of occurrences of D matches between the information vector and the Swift matrix vectors corresponding to one frame period for a 240 row display of this invention.

In FIG. 9, F(D) is plotted versus the number of matches D in a 240 row matrix. The plot describes a bell-shaped curve showing that on the average there will be one occurrence of 103 matches for each frame period T. The number of occurrences increases to 13 at 120 matches and decreases again to one occurrence of 137 matches. In view of FIG. 9 a minimum of about 35 levels is required to substantially display a complete image during one frame rather than the 241 levels as would generally be expected.

Of course F(D)<1 does not mean that this value of D will never occur. It just means that more than one frame period must elapse before that value of D is likely to occur. F(D)=0.1 or 0.01, for example, implies that, on the average, 10 or 100 frame periods must elapse before that value of D is likely to occur. The very steep, exponential fall-off of the normal distribution curve insures that the number of levels required to practicably implement the addressing scheme of the present invention is not very much larger than the minimum number.

TABLE 4

| number of +1s in Swift column vector | number of +1s in information vector | number of matrix rows N | resulting number of matches D | maximum number of levels |
|---|---|---|---|---|
| odd | odd | odd | odd | (N + 1)/2 |
| odd | odd | even | even | (N + 2)/2 |
| even | even | odd | odd | (N + 1)/2 |
| even | even | even | even | (N + 2)/2 |
| even | odd | odd | even | N/2 |
| even | odd | even | odd | (N + 1)/2 |
| odd | even | odd | even | N/2 |
| odd | even | even | odd | (N + 1)/2 |

Of course a general information vector $I_j$ is just as likely to have an even number of +1s as an odd number of +1s. So in order to employ this level reduction scheme information vectors $I_1$–$I_M$ having the wrong parity must be changed to the right parity. One way to accomplish this would be to add an extra matrix row as a parity check and setting its corresponding column information elements to be either +1 or −1 to ensure the correct parity. The information pattern displayed on the last matrix row would necessarily be meaningless, but it could be masked off in order not to disturb the viewer. Or, alternatively, the last matrix row could be implemented as a "phantom" or "virtual" row which would exist electronically but not be connected to a real display row electrode.

Employing this level reduction scheme of the present invention to a 240 row display (N=240, s=8), for example, would reduce the minimum number of levels required from 35 to about 18.

Figure 10:
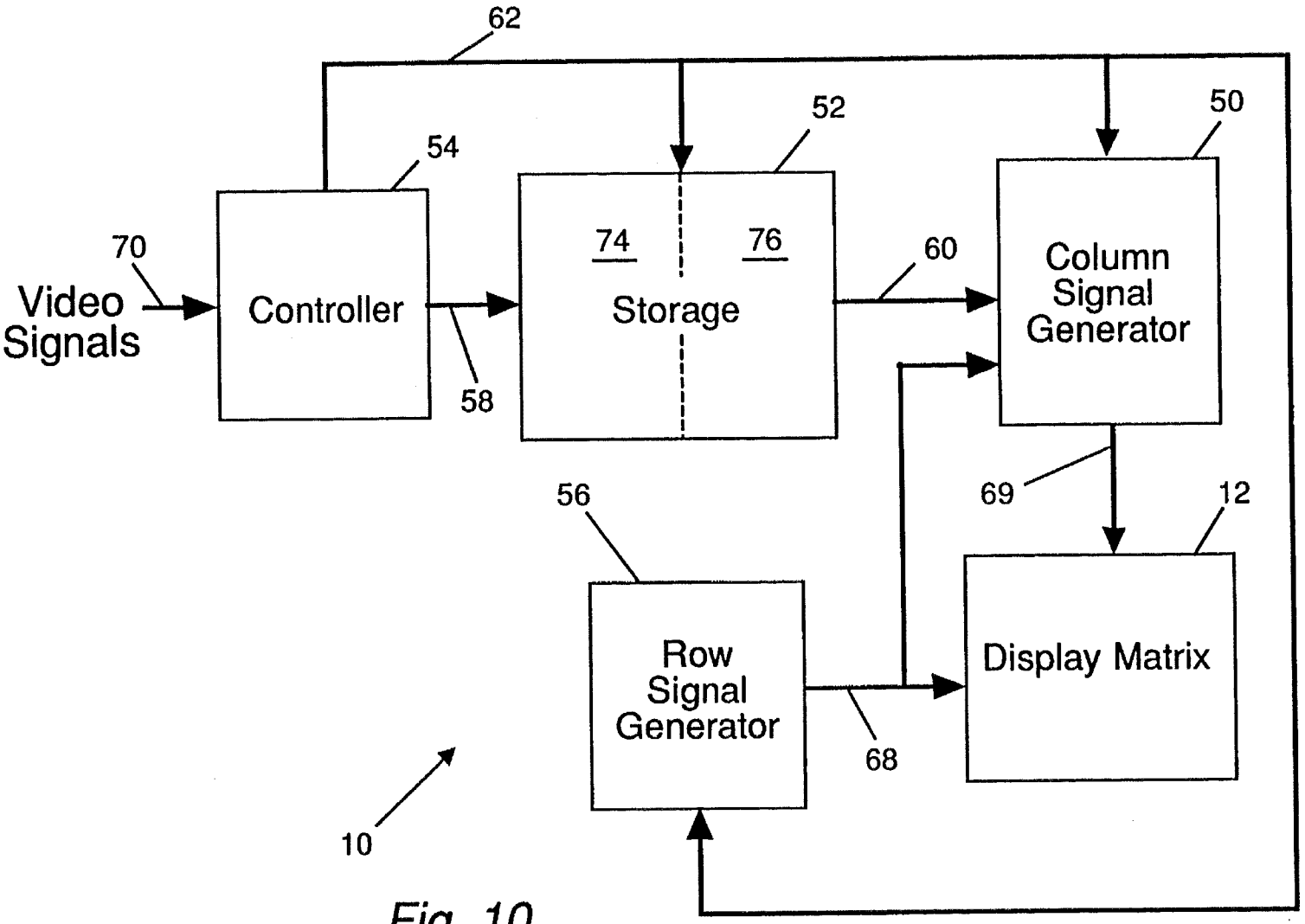
FIG. 10 is a block diagram of the apparatus of the present invention.

Hardware Implementation and Description of Operation of the Present Invention A Preferred General Embodiment:

Referring now to FIG. 10, a block diagram of one embodiment for implementing the present invention is shown.

Reduction of Number of Levels for Special Swift Matrices:

With some embodiments of the present invention it may be advantageous to reduce the number of voltage levels presented to column electrodes $\mathbf{24}_1$–$\mathbf{24}_M$ to the absolute minimum. This could be particularly important, for example, if column signals $\mathbf{30}_1$–$\mathbf{30}_M$ were generated by the output of an analog multiplexer which is switched between a plurality of fixed voltage levels based on a digital input.

Some Swift matrices have the special property that the total number of +1 elements in any column vector is either always an even number or always an odd number. For example, in the 240 row Swift matrix based on the 256 row Walsh matrix with the 16 lowest sequency waves removed, every column has an even number of +1 elements. This result is preserved if the Swift matrix is modified further by inverting an even number of rows. If an odd number of rows is inverted then the total number of +1 elements in every column would be an odd number.

The number of voltage levels required by column signals $\mathbf{30}_1$–$\mathbf{30}_M$ can be cut in half from the usual number by employing these special Swift matrices and forcing the number of +1 elements in information vector $I_j$ to be either always an even number or always an odd number. The number of levels is cut in half because under these conditions the number of matches, D, between Swift column vector $S_k$ and information column vector $I_j$ is forced to be either always an even number or always an odd number between 0 and N, inclusive. The possible combinations of column parity, information parity and row parity with their resulting match parity and number of reduced levels are summarized below in Table 4.

Although the embodiments are discussed using Swift functions, it is to be understood that other functions may be used.

Display system 10 comprises display 12, a column signal generator 50, a storage means 52, a controller 54, and a row signal generator 56. A data bus 58 electrically connects controller 54 with storage means 52. Similarly, a second data bus 60 connects storage means 52 with column signal generator 50. Timing and control bus 62 connects controller 54 with storage means 52, column signal generator 50 and row signal generator 56. A bus 68 provides row signal information from row signal generator 56 to column signal generator 50. Bus 68 also electrically connects row signal generator 56 with display 12, Controller 54 receives video signals from an external source (not shown) via an external bus 70.

The video signals on bus 70 include both video display data and timing and control signals. The timing and control signals may include horizontal and vertical sync information. Upon receipt of video signals, controller 54 formats the display data and transmits the formatted data to storage means 52. Data is subsequently transmitted from storage means 52 to column signal generator 50 via bus 60.

Timing and control signals are exchanged between controller 54, storage means 52, row signal generator 56 and column signal generator 50 along bus 62.

Figure 11:
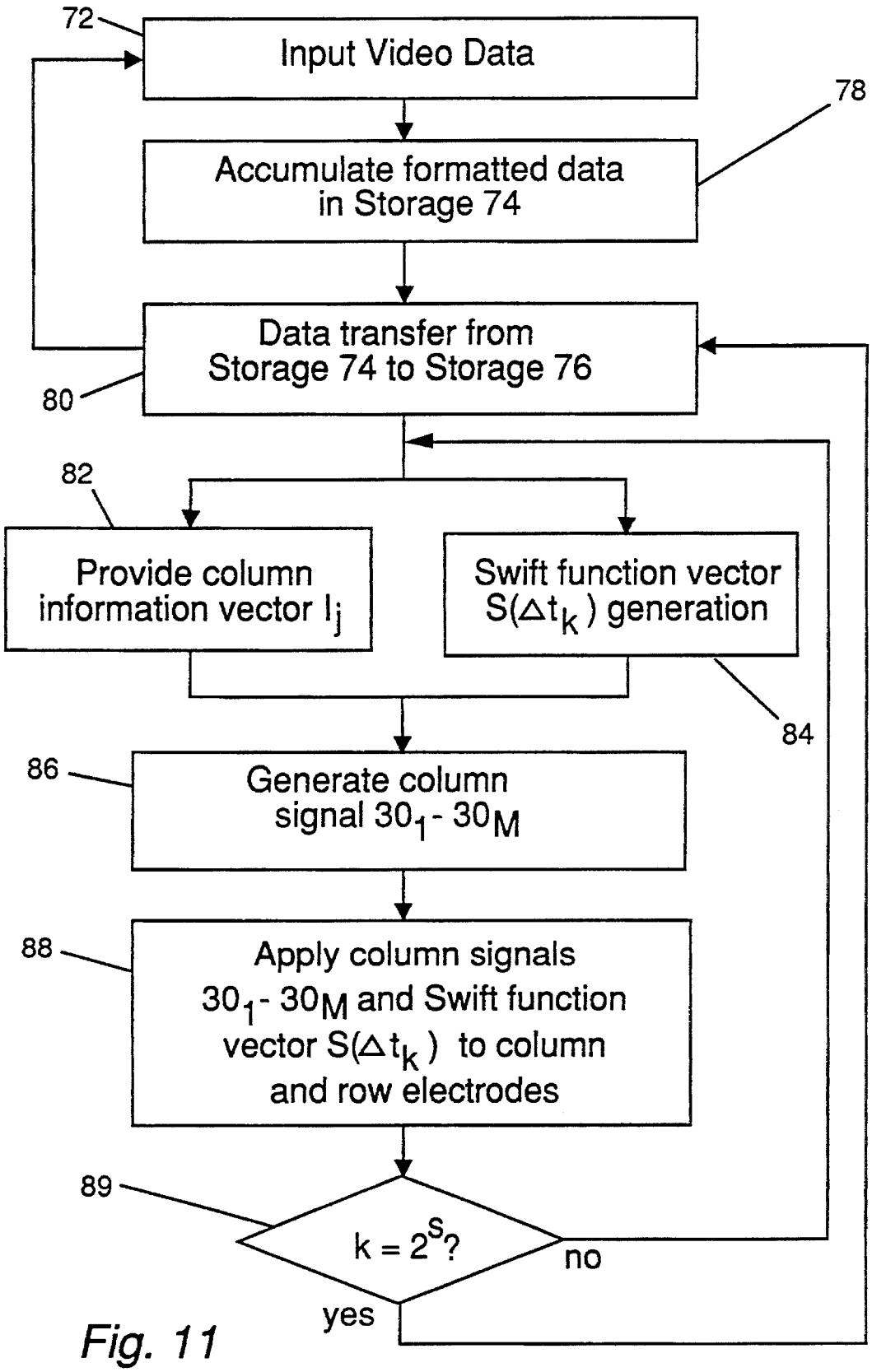
FIG. 11 is a flowchart of the basic operation of one embodiment of the apparatus of the present invention.

Referring now to FIG. 11, the operation of display system 10 will be described in conjunction with the embodiment shown in FIG. 10. FIG. 11 depicts a flowchart summary of the operating sequence or steps performed by the embodiment of FIG. 10.

As indicated at step 72, video data, timing and control information are received from the external video source by controller 54. Controller 54 accumulates a block of video data, formats the display data and transmits the formatted display data to storage means 52.

Storage means 52 comprises a first storage circuit 74 for accumulating the formatted display data transferred from controller 54 and a second storage circuit 76 that stores the display data for later use.

In response to control signals provided by controller 54, storage means 52 accumulates or stores the formatted display data (step 78) in storage circuit 74. Accumulating step 78 continues until display data corresponding to the N rows by M columns of pixels have been accumulated.

When an entire frame of display data has been accumulated, controller 54 generates a control signal that initiates transfer of data from storage circuit 74 to storage circuit 76 during transfer step 80.

At this point in the operation of display system 10, controller 54 initiates three operations that occur substantially in parallel. First, controller 54 begins accepting new video data (step 72) and accumulating a new frame of data (step 78) in storage circuit 74. Second, controller 54 initiates the process for converting the display data stored in storage circuit 76 into column signals $\mathbf{30}_1$–$\mathbf{30}_M$ having amplitudes $G_{I_1}(\Delta t_k)$–$G_{I_M}(\Delta t_k)$ beginning at step 82. Third, controller 54 instructs row signal generator 56 to supply a Swift vector $S(\Delta t_k)$ for time interval $\Delta t_k$ to column signal generator 50 and to display 12. The third operation is referred to as the Swift function vector generation step 84 during which a Swift function vector $S(\Delta t_k)$ is generated or otherwise selectively provided to column signal generator 50. Swift function vector $S(\Delta t_k)$ is also provided directly to display 12.

As described above, N Swift functions $S_i$ are provided by row signal generator 56, one Swift function for each row. The N Swift functions $S_i$ are periodic in time and the period is divided into at least $2^s$ time intervals, $\Delta t_k$ (where k=1 to $2^s$). Therefore, there are a total of N unique Swift functions $S_i$, one for each row 22 of display 12, with each divided into $2^s$ time intervals $\Delta t_k$. A Swift function vector $S(\Delta t_k)$ is comprised of all N Swift functions $S_i$ at a specific time interval $\Delta t_k$. Because there are at least $2^s$ time intervals $\Delta t_k$, there are at least $2^s$ Swift function vectors $S(\Delta t_k)$. Swift function vectors $S(\Delta t_k)$ are applied to rows 22 of display 12 by row signal generator 56 so that each element $S_i$ of Swift function vector $S(\Delta t_k)$ is applied to the corresponding row $\mathbf{22}_i$ of display 12 at time interval $\Delta t_k$. Swift function vectors $S(\Delta t_k)$ are also used by column signal generator 50 in generating column signals $\mathbf{30}_1$–$\mathbf{30}_M$ each having a corresponding amplitude $G_{I_1}(\Delta t_k)$ through $G_{IM}(\Delta t_k)$.

Display data stored in storage circuit 76 are provided to the column signal generator 50 at step 82. In this manner, an information vector $I_j$ is provided to column signal generator 50 such that each element $I_{ij}$ of information vector $I_j$ represents the display state of a corresponding pixel in the $j^{th}$ column. An information vector $I_j$ is provided for each of the M columns of pixels of display 12.

During column signal generation step 86, each information vector $I_j$ is combined with the Swift function vector $S(\Delta t_k)$ to generate a column signal $\mathbf{30}_j$ for the $j^{th}$ column during the $k^{th}$ time interval. Column signals $\mathbf{30}_1$–$\mathbf{30}_M$, each having amplitude $G_{I_j}(\Delta t_k)$, are generated for each of the M columns of display 12 for each time interval $\Delta t_k$. When the amplitude $G_{I_j}(\Delta t_k)$ for all column signals $\mathbf{30}_1$–$\mathbf{30}_M$ is calculated for time interval $\Delta t_k$, all column signals $\mathbf{30}_1$–$\mathbf{30}_M$ are presented, in parallel, to column electrodes $\mathbf{24}_1$–$\mathbf{24}_M$ during time interval $\Delta t_k$ via bus 69. At the same time, the $k^{th}$ Swift function vector $S(\Delta t_k)$ is applied to row electrodes $\mathbf{22}_1$–$\mathbf{22}_N$ of display 12 via bus 68 as indicated by step 88.

After column signals $\mathbf{30}_1$–$\mathbf{30}_M$ have been presented, the k+1 Swift vector $S(\Delta t_{k+1})$ is selected and steps 82–88 are repeated as indicated by the "no" branch of decision step 89. When all $2^s$ Swift function vectors $S(\Delta t_k)$ have been combined with all information vectors $I_1$–$I_M$, the "yes" branch of decision of step 89 instructs controller to return to step 80 and transfer the accumulated frame of information vectors $I_1$–$I_M$ to storage means 76 (step 80) and the entire process is repeated.

Figure 12:
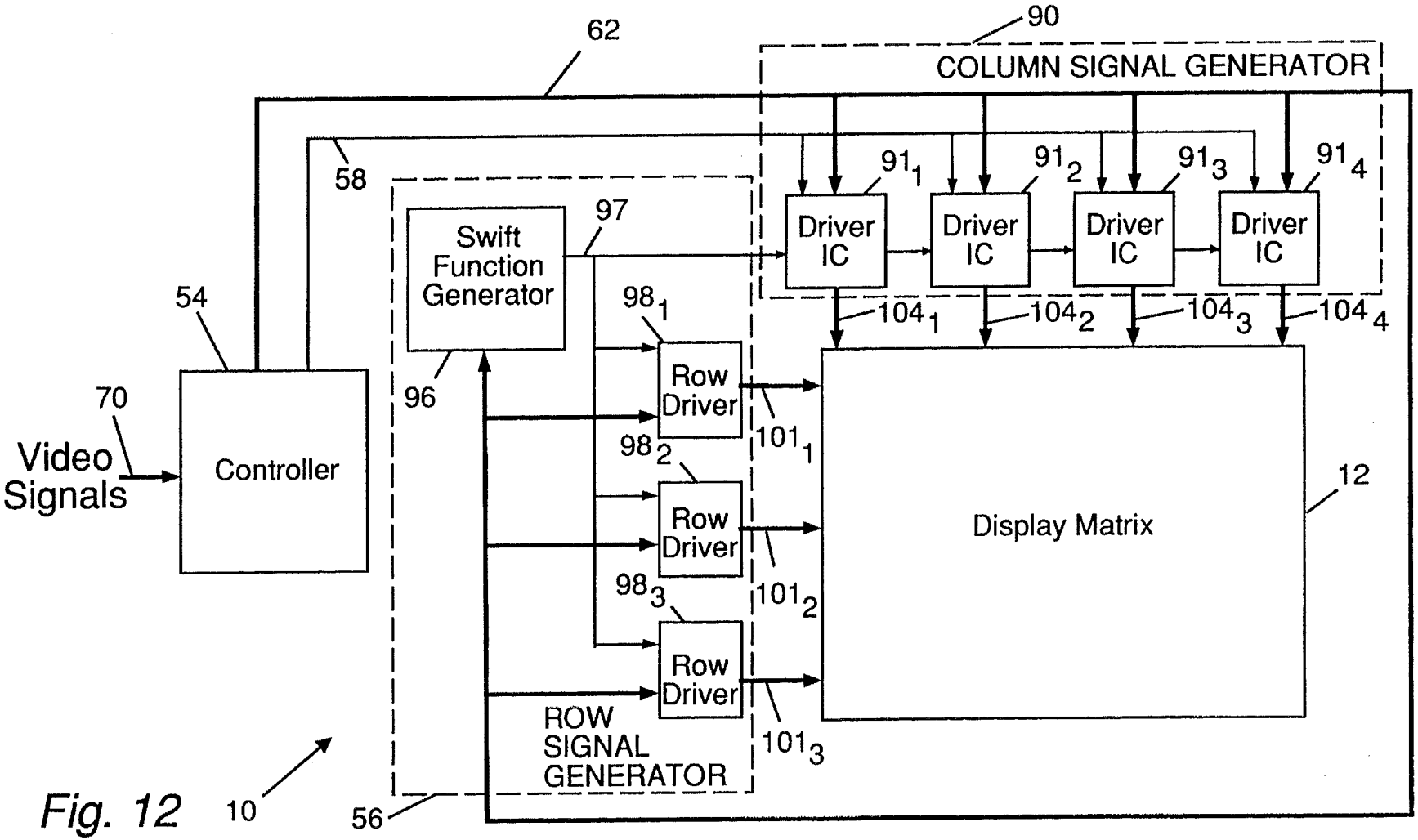
FIG. 12 is a block diagram of one embodiment of the present invention for addressing an LCD display system.

Integrated Driver Embodiment:

Referring now to FIG. 12, another preferred embodiment of display system 10 is shown where storage means 52 (FIG. 10) is incorporated with column signal generator 50 in a circuit 90. Circuit 90 comprises a plurality of integrated driver integrated circuits (ICs) $\mathbf{91}_1$–$\mathbf{91}_4$. Row signal generator 56 is shown as comprising a Swift function generator 96 and a plurality of row driver integrated circuits (ICs) $\mathbf{98}_1$–$\mathbf{98}_3$. It should be apparent to one skilled in the art that the actual number of ICs $91_1$–$91_4$ and $98_1$–$98_3$ depends on the number of rows and columns of display 12.

Swift function generator 96 may include circuits, such as the circuit of FIG. 6, to generate Swift function vectors $S(\Delta t_k)$ for each time interval $\Delta t_k$. Preferably, however, Swift function generator 96 comprises a read-only memory (ROM) having the Swift functions stored therein. Output bus 97 of Swift function generator 96 is connected to integrated driver ICs $91_1$–$91_4$ and to row driver ICs $98_1$–$98_3$.

Row driver ICs $98_1$–$98_3$ are preferably similar to the integrated circuit having the part number HD66107T, available from Hitachi America Ltd. In FIG. 12, each row driver IC $98_1$–$98_3$ is capable of driving 160 rows of display 12. For the case of N=480, three such row driver ICs $98_1$–$98_3$ are required. Row driver ICs $98_1$–$98_3$ are connected to row electrodes $22_1$–$22_N$ of display 12 in a known manner as indicated by electrical interconnections $101_1$–$101_3$. Similarly, driver ICs $91_1$–$91_4$ are connected to column electrodes $24_1$–$24_M$ in a known manner as indicated by electrical interconnections $104_1$–$104_4$.

As in the previous embodiment of FIG. 10, controller 54 receives video data and control signals via bus 70 from the external video source, formats the video data and provides timing control and control signals to integrated driver ICs $91_1$–$91_4$, Swift function generator 96 and row driver ICs $98_1$–$98_3$. Controller 54 is connected to integrated driver ICs $91_1$–$91_4$ by control bus 62 and formatted data bus 58. Controller 54 is also connected to row driver ICs $98_1$–$98_3$ and to Swift function generator 96 by control bus 62. Signals on control bus 62 cause Swift function generator 96 to provide the next sequentially following Swift function vector $S(\Delta t_{k+1})$ to integrated driver ICs $91_1$–$91_4$ and to row driver ICs $98_1$–$98_3$.

Figure 13:
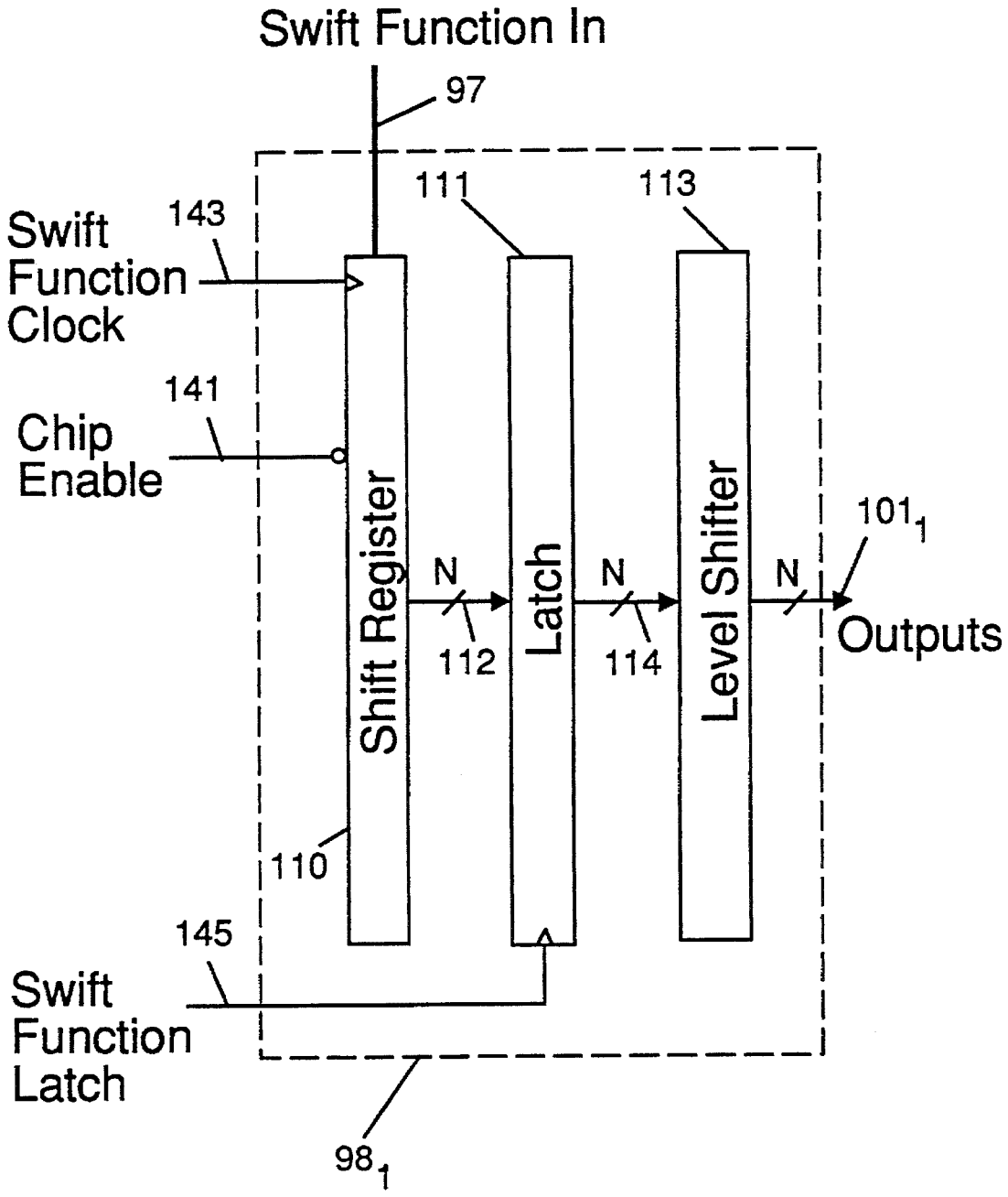
FIG. 13 is a block diagram of a row driver IC shown in FIG. 12.

Operation of row driver IC $98_1$ is now described in conjunction with FIG. 13. Although only row driver $98_1$ is described, it is understood that row driver ICs $98_1$–$98_3$ operate in a similar manner.

Row driver IC $98_1$ comprises an n-element shift register 110 electrically connected to an n-element latch 111 by bus 112. Latch 111 is in turn electrically connected to an n-element level shifter 113 by bus 114. Preferably, the n-element registers 110, latches 111, and level shifters 113 are large enough to accommodate all N rows of the display with one row driver IC, that is, n=N. However, a plurality of row driver ICs may be used so that the number of row driver ICs multiplied by n is at least N. In such case, a chip enable input is provided on control line 141 which allows multiple row driver ICs to be cascaded.

A Swift function vector $S(\Delta t_k)$ is shifted into shift register 110, element by element, from Swift function generator 96 on output bus 97 in response to a clock signal from controller 54 on Swift function clock line 143. When a complete Swift function vector $S(\Delta t_k)$ is shifted into shift register 110, the vector is transferred from the shift register 110 to latch 111 in response to a clock pulse provided by controller 54 on Swift function latch line 145. Clock line 143 and latch line 145, as is control line 141, are all elements of control bus 62.

The outputs of the n-element Swift function latch 111 are electrically connected to the corresponding inputs of an n-element level shifter 113, which translates the logical value of each element $S_i(\Delta t_k)$ of the current Swift function vector $S(\Delta t_k)$ into either a first or a second voltage level, depending on the logical value of $Si(\Delta t_k)$. The resulting level-shifted Swift function vector, which now has values of either first or second voltages, is applied directly to the corresponding row electrodes $22_1$ through $22_n$ for the duration of time interval $\Delta t_k$ via electrical connections $101_1$.

Figure 14:
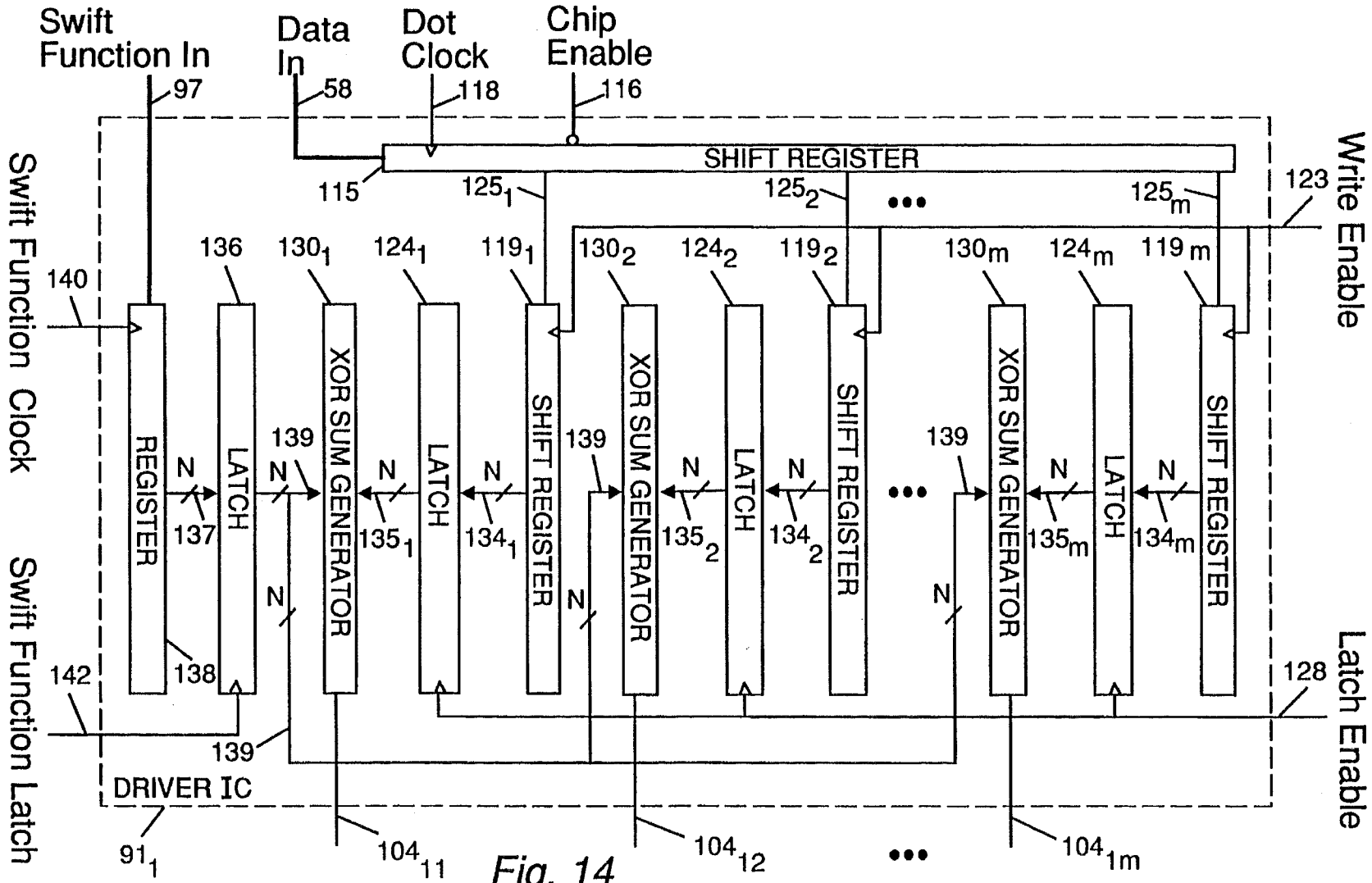
FIG. 14 is a more detailed block diagram of the integrated column driver IC shown in FIG. 12.

The design and operation of integrated driver ICs $91_1$–$91_4$ is more easily understood with reference to FIG. 14 where integrated driver IC $91_1$ is serially shown in greater detail. It is understood that integrated drivers $91_2$–$91_4$ operate in a similar manner.

Integrated driver IC $91_1$ receives formatted data from controller 54 on data bus 58 and control and timing signals on control and clock lines 116, 118, 123, 128, 140 and 142. Control and clock lines 116, 118, 123, 128, 140 and 142 are elements of bus 62. The Swift function vector $S(\Delta t_k)$ is received by IC $91_1$ from Swift function generator 96 on output bus 97.

Shift register 115 is adapted to receive the formatted data when enabled by control line 116. The data are transferred into register 115 at a rate determined by the clock signal provided by controller 54 on clock line 118. In the preferred embodiment, register 115 is m bits in length, so that the number of integrated driver ICs $91_1$–$91_4$ multiplied by m is at least M, the number of column electrodes $24_1$–$24_M$ in display 12.

It should be understood that when register 115 is full with m bits (where m<M), the corresponding register 115 of integrated driver IC $91_2$ is enabled to receive formatted data. Similarly, the remaining integrated driver ICs $91_3$ and $91_4$ are sequentially enabled and formatted data is directed into appropriate registers. In this manner, one row of formatted data comprising M bits of formatted data are transferred from controller 54 to integrated driver ICs $91_1$–$91_4$.

The contents of register 115 are then transferred in parallel to a plurality of N-element shift registers $1191$-$119_m$ via connections $125_1$–$125_m$ in response to a write enable signal provided by controller 54 on control line 123. In the preferred embodiment, there are m shift registers in each integrated driver IC $91_1$–$91_4$ so that the number of integrated driver ICs $91_1$–$91_4$ multipled by m provides a shift register corresponding to each of the M columns of display 12.

When registers $119_1$–$119_m$ are full, each register $119_1$–$119_m$ contains an information vector $I_j$ for the $j_{th}$ column. Each bit $I_{ij}$ of information vector $I_j$ corresponds to the display state of the $i^{th}$ pixel in the $j^{th}$ column. Information vector $I_j$ is then transferred to a corresponding latch $124_1$–$124_m$ via bus $134_1$–$134_m$. One latch $124_1$–$124_m$ is provided for each of the m column registers $119_1$–$119_m$. A latch enable signal on control line 128 initiates the transfer from registers $119_1$–$119_m$ to the corresponding latch $124_1$–$124_m$. Latches $124_1$–$124_m$ have N inputs and N outputs and store information vectors $I_1$–$I_m$ (that is, one column of N bits for each column j) that represent the display states of the pixels 26 of the corresponding column of display 12 for one frame period T.

The N outputs of latches $124_1$–$124_m$ are electrically connected by buses $135_1$–$135_m$ to corresponding exclusive-or (XOR) sum generators $130_1$–$130_m$ at a first set of N inputs. Each XOR sum generator $130_1$–$130_m$ has a second set of N inputs connected to corresponding outputs of an N-element latch 136 by bus 139. Latch 136 provides the Swift function vector $S(\Delta t_k)$ to each of the XOR sum generators $130_1$–$130_m$ to enable generation of column signals 30.

Latch 136 has N inputs electrically connected via bus 137 to an N-element shift register 138. Output bus 97 connects Swift function generator 96 (FIG. 12) to register 138. In response to a Swift function clock 140 provided by controller 54, a Swift function vector $S(\Delta t_k)$ is sequentially clocked into register 138 via output bus 97 in a manner similar to that described above.

For each frame period, the first Swift function vector $S(\Delta t_1)$ is transferred, in response to a clock signal on control line 142, to latch 136. Following the transfer to latch 136, the second Swift function vector $S(\Delta t_2)$ is clocked into register 138 while the first Swift function vector $S(\Delta t_1)$ is combined by XOR sum generators $\mathbf{130}_1$–$\mathbf{130}_m$ with information vectors $I_1$–$I_m$ in latches $\mathbf{124}_1$–$\mathbf{124}_m$ to generate column signals $\mathbf{30}_1$–$\mathbf{30}_M$ each having an amplitude $G_{I_j}(\Delta t_1)$. Column signals $\mathbf{30}_1$–$\mathbf{30}_M$ are output on connections $\mathbf{104}_{11}$–$\mathbf{104}_{1m}$ during the time interval $\Delta t_1$. At the same time, the Swift function vector $S(\Delta t_k)$ is output on electrical connections $\mathbf{101}_1$–$\mathbf{101}_3$.

The process of transferring the Swift function vector $S(\Delta t_k)$ to latch 136, clocking in the next Swift function vector $S(\Delta t_{k+1})$ into register 138 and combining the Swift function vector $S(\Delta t_k)$ with information vector $I_j$ and outputting the resulting column signals $\mathbf{30}_1$–$\mathbf{30}_M$ to the column electrodes $\mathbf{24}_1$–$\mathbf{24}_M$ and outputting the corresponding Swift function vector $S(\Delta t_k)$ to row electrodes $\mathbf{22}_1$–$\mathbf{22}_N$ continues until all Swift function vectors $S(\Delta t_k)$ (i.e., until $k=2^s$) have been combined with the current column information vectors $I_1$–$I_m$ held in latches $\mathbf{124}_1$–$\mathbf{124}_m$. At this point, a new frame of information vectors $I_1$–$I_M$ is transferred from registers $\mathbf{119}_1\mathbf{119}_m$ to latches $\mathbf{124}_1$–$\mathbf{124}_m$ and the process is repeated for the next frame period T+1.

Figure 15:
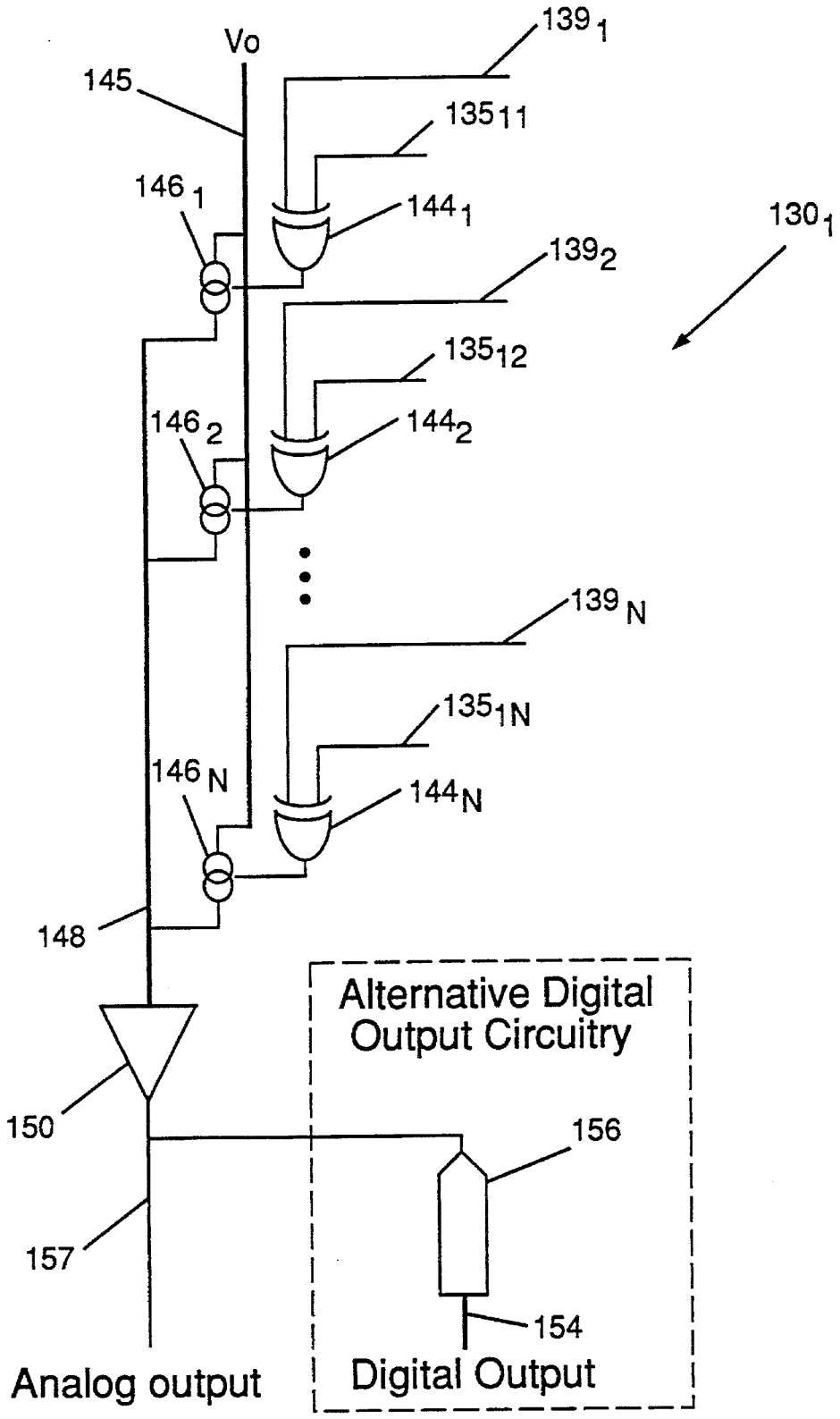
FIG. 15 is a block diagram of one embodiment of the XOR sum generator shown in FIG. 14.

Exclusive-Or (XOR) Generators:

There are various possible embodiments for implementing the XOR summation performed by XOR sum generators $\mathbf{130}_1$–$\mathbf{130}_m$. A first embodiment is shown in FIG. 15. For the purpose of explanation, only one XOR sum generator $\mathbf{130}_1$, will be discussed, it being understood that all m XOR sum generators $\mathbf{130}_2$–$\mathbf{130}_m$ operate in like manner.

The first set of inputs of XOR sum generator $\mathbf{130}_1$ electrically connect, via bus $\mathbf{135}_{11}$–$\mathbf{135}_{1N}$, each output of latch $\mathbf{124}_1$ to a corresponding input of N two-input XOR logic gates $\mathbf{144}_1$–$\mathbf{144}_N$. The second input of each XOR gate $\mathbf{144}_1$–$\mathbf{144}_N$ is electrically connected to a corresponding bit of latch 136 by bus $\mathbf{139}_1$–$\mathbf{139}_N$.

The output of each XOR gate $\mathbf{144}_1$–$\mathbf{144}_N$ is connected to a corresponding input of a current source, designated $\mathbf{146}_1$–$\mathbf{146}_N$. The outputs of current sources $\mathbf{146}_1$–$\mathbf{146}_N$ are connected in parallel at a common node 148. The single input of a current-to-voltage converter 150 is also connected to node 148.

Current sources $\mathbf{146}_1$–$\mathbf{146}_N$ are designed to provide either a first or second current output level depending on the combination of the inputs at each corresponding XOR gate $\mathbf{146}_1$–$\mathbf{146}_N$. If the output of the corresponding XOR gate is logic low, the first current output level is provided to common node 148. Similarly, if the output is logic high, the second current output level is provided. In this manner, the magnitude of current at node 148 is the sum of the current levels generated by the N current sources $\mathbf{146}_1$–$\mathbf{146}_N$. As discussed above, the magnitude of the current will depend on the number of matches D between the Swift vector $S(\Delta t_k)$ and information vector $I_j$. Bus 145 routes power to each current source $\mathbf{146}_1$–$\mathbf{146}_N$.

Converter 150 converts the total current level at node 148 to a proportional voltage output. The voltage output of converter 150 is the amplitude $G_{I_j}(\Delta t_k)$ of column signal $\mathbf{30}_j$ for the $j_{th}$ column of display 12 at output 157.

In a slightly different embodiment, an A/D converter 156 converts the analog voltage at output 157 to a digital value representative of column signal $\mathbf{30}_j$. The output of A/D converter 156 is provided on output 154.

As noted above, there are various embodiments for implementing the XOR sum generators $\mathbf{130}_1$–$\mathbf{130}_m$ of FIG. 14. One such embodiment, shown in FIG. 16, eliminates the N current sources $\mathbf{146}_1$–$\mathbf{146}_N$ by using a digital summing circuit 152. A multi-bit digital word, which is the digital representation of the sum of the outputs of XOR gates $\mathbf{144}_1$–$\mathbf{144}_N$, is output on bus 154. The digital representation is subsequently processed to generate column signal $\mathbf{30}_j$. The width of digital word output by circuit 152 will depend on the number of rows in display 12 and the number of discrete voltage levels that will be needed to represent column signals $\mathbf{30}_1$–$\mathbf{30}_M$.

Figure 16:
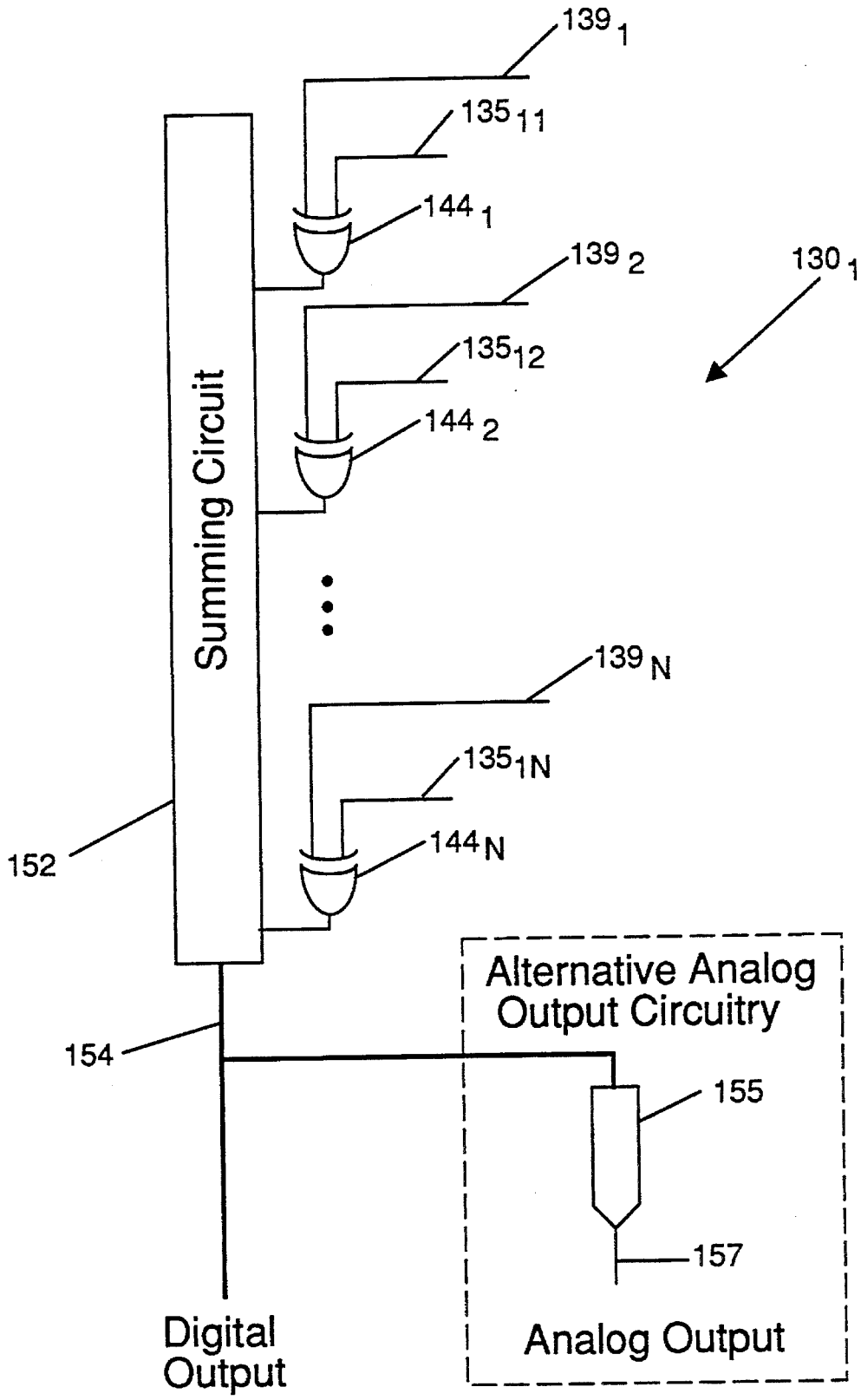
FIG. 16 is a block diagram of a second embodiment of the XOR sum generator.

The digital word provided on bus 154 may be subsequently processed by a digital-to-analog converter (DAC) 155 shown in FIG. 16. DAC 155 produces an analog voltage at its output 157 that is proportional to the value of the digital word on bus 154. This may be done with a conventional digital-to-analog converter, or by using an analog multiplexer to select from a plurality of voltages.

Figure 17:
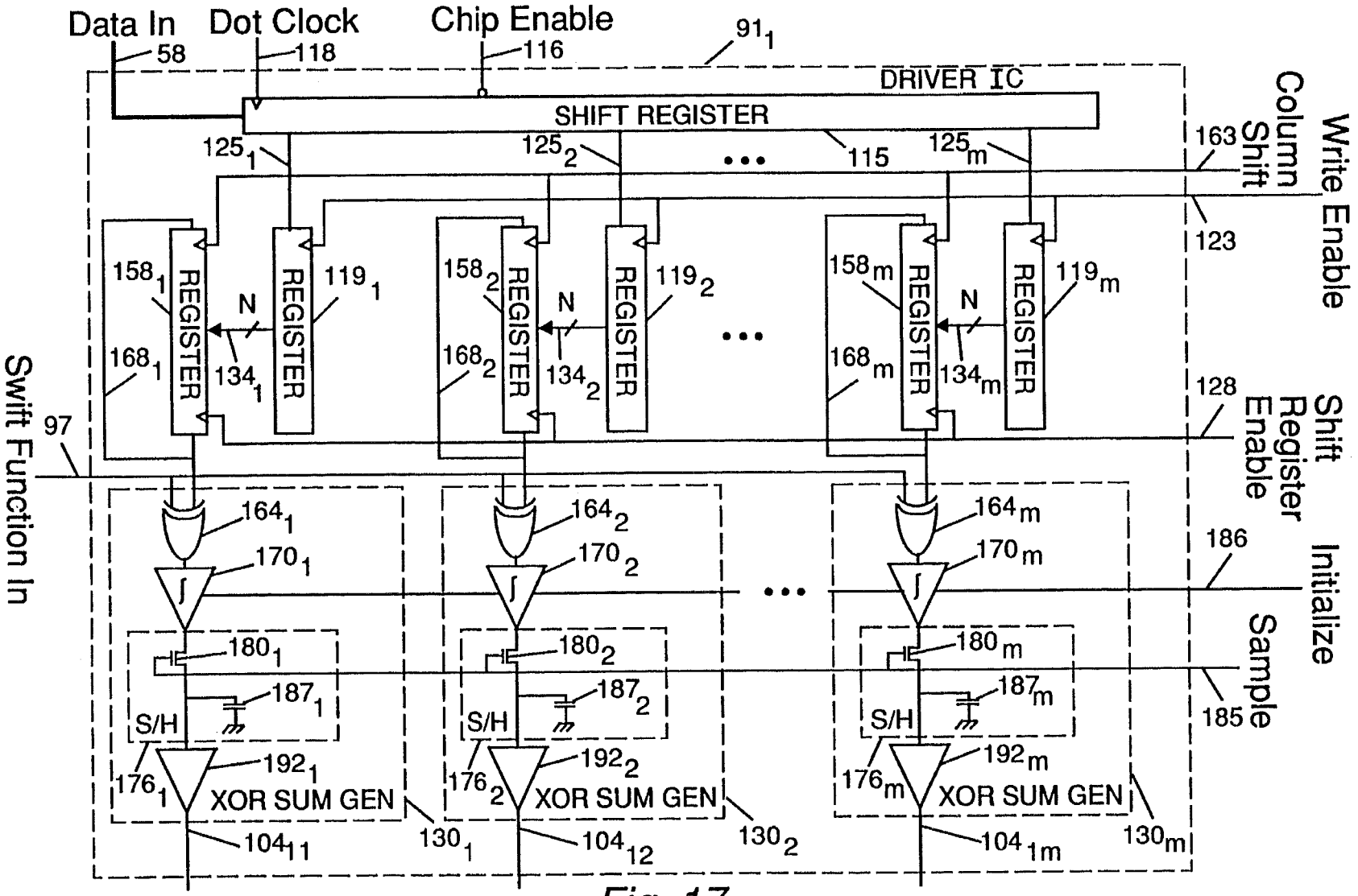
FIG. 17 is a block diagram of the integrated driver of FIG. 14 with a third embodiment of the XOR sum generator.

Another embodiment of XOR sum generator $\mathbf{130}_1$–$\mathbf{130}_N$ is shown in FIG. 17. In this embodiment register 138 and latch 136 are eliminated as are the N current sources $\mathbf{146}_1$–$\mathbf{146}_N$. Register 115 receives formatted data from controller 54 and registers $\mathbf{119}_1$–$\mathbf{119}_m$ are filled in the manner described for the embodiment of FIG. 14. However, when registers $\mathbf{119}_1$–$\mathbf{119}_m$ are filled, the contents are transferred in parallel via buses $\mathbf{134}_1$–$\mathbf{134}_m$ to a second set of N-element shift registers $\mathbf{158}_1\mathbf{158}_m$ in response to a shift register enable signal provided by controller 54 on control line 128. As before, registers $\mathbf{119}_1\mathbf{119}_m$ are available to be updated with the next frame of formatted data.

The output of each register $\mathbf{158}_1$–$\mathbf{158}_m$ is electrically connected to one input of a corresponding two-input XOR gate $\mathbf{164}_1$–$\mathbf{164}_m$. The second input of each XOR gate $\mathbf{164}_1$–$\mathbf{164}_m$ are connected in parallel to output bus 97 of Swift function generator 96.

For each time interval $\Delta t_k$, the contents of registers $\mathbf{158}_1$–$\mathbf{158}_m$ are sequentially shifted out in response to a series of clock pulses on control line 163. Simultaneously, a Swift function vector $S(\Delta t_k)$ is presented, element by element to the second input of XOR gates $\mathbf{164}_1$–$\mathbf{164}_m$. The XOR product of each information vector $I_j$ times the Swift function vector $S(\Delta t_k)$ is therefore sequentially determined by XOR gates $\mathbf{164}_1$–$\mathbf{164}_m$.

To preserve the contents of registers $\mathbf{158}_1$–$\mathbf{158}_m$ for the entire duration of frame period T, the bits shifted out of registers $\mathbf{158}_1$–$\mathbf{158}_m$ are fed back in via buses $\mathbf{168}_1$–$\mathbf{168}_m$. Each information vector $I_j$ is recirculated until a new frame of information vectors $I_1$–$I_m$ are transferred from registers $\mathbf{119}_1\mathbf{119}_m$ at the start of the next frame period T+1. In this manner, each information vector $I_j$ is preserved for the duration of the respective frame period T.

The outputs of XOR gates $\mathbf{164}_1$–$\mathbf{164}_m$ are electrically connected to the corresponding inputs of a plurality of integrators $\mathbf{170}_1$–$\mathbf{170}_m$. Integrators $\mathbf{170}_1$–$\mathbf{170}_m$ integrate the output signals of XOR gates $\mathbf{164}_1$–$\mathbf{164}_m$ during time interval $\Delta t_k$. By integrating the plurality of pulses generated by XOR gates $\mathbf{164}_1$–$\mathbf{164}_m$, the output of integrators $\mathbf{170}_1$–$\mathbf{170}_m$ will be at a voltage proportional to the sum of the XOR products. At the end of time interval $\Delta t_k$, a corresponding plurality of sample and hold circuits $\mathbf{176}_1$–$\mathbf{176}_m$ are enabled. After sample and hold circuits $\mathbf{176}_1$–$\mathbf{176}_m$ have stored the amplitude $G_{I_j}(\Delta t_k)$ of column signals $\mathbf{30}_1$–$\mathbf{30}_M$, a pulse on initialize line 186 provided by controller 54, at the beginning of the next time interval $\Delta t_{k+1}$, resets the integrators $170_1$–$170_m$ to a common initial condition.

Sample and hold circuits $176_1$–$176_m$ each comprise a pass transistor $180_1$–$180_m$ controlled by a signal provided by controller 54 on control line 185. Transistors $180_1$–$180_m$ permit the voltage output of integrators $170_1$–$170_m$ to be selectively stored by capacitors $187_1$–$187_m$.

The sample and hold circuits $176_1$–$176_m$ are followed by buffers $192_1$–$192_m$ each of which applies a voltage signal to a corresponding one of column electrodes $24_1$–$24_M$ of display 12 (FIG. 1). The voltage provided by buffers $192_1$–$192_m$ is proportional to the sum of the XOR products. This voltage corresponds to the amplitude $G_{I_j}(\Delta t_k)$ of column signal $30_j$. Sample and hold circuits $176_1$–$176_m$ hold the XOR sum for the entire duration of the next time interval $\Delta t_k+_1$ and therefore, buffers $192_1$–$192_m$ apply the respective signals for the same duration. The Swift function vector $S(\Delta t_k)$ is applied to the row electrodes $22_1$–$22_N$ by row drivers $98_1$–$98_3$ during time interval $\Delta t_k+_1$.

After the XOR sums for the first time interval $\Delta t_k$ are generated, the process is repeated for the next time interval $\Delta t_{k+1}$ except that a new Swift function vector $S(\Delta t_{k+1})$ is used for the XOR sum. The process is repeated until all Swift function vectors have been used in a single frame period T. At this point, a new frame period begins and the entire process repeats with a new frame of display information.

In the above embodiments of the XOR sum generators $130_1$–$130_m$, it may be advantageous to either limit the amplitude $G_{I_j}(\Delta t_k)$ of the generated column signals $30_1$–$30_M$ or limit the total number of discrete levels column signals $30_1$–$30_M$ may assume or both. Such limiting, while not significantly degrading the displayed image, may reduce the overall cost of display system 10.

Of course, the embodiment of the XOR sum generators $130_1$–$130_m$ is not limited to those presented here, and those skilled in the art can envision many embodiments that perform the XOR sum generation function.

Figure 18:
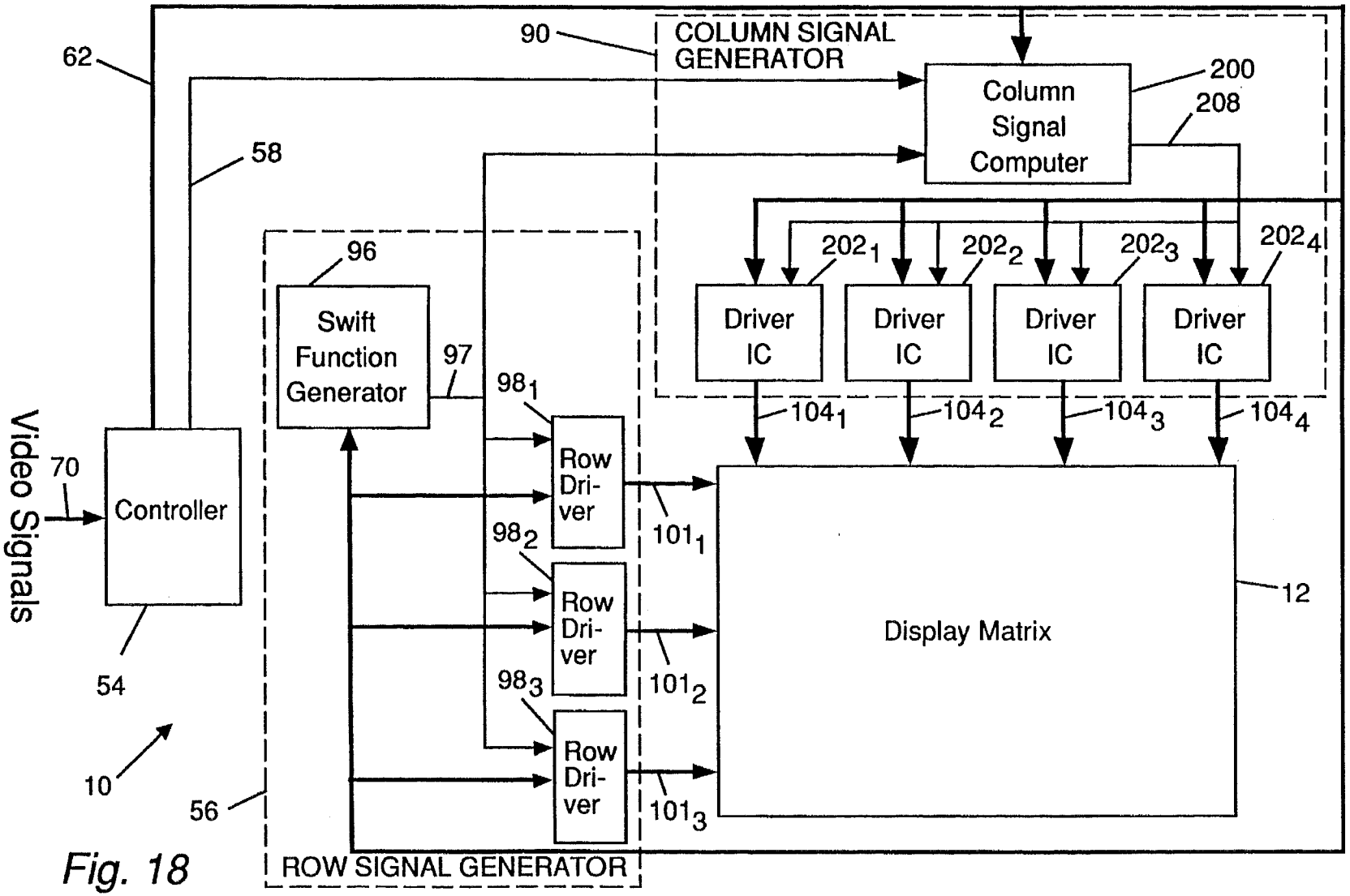
FIG. 18 is a block diagram of a second embodiment of the present invention for addressing an LCD display system.

Column Signal Computer Embodiment:

A second embodiment for the addressing display system 10 is shown in FIG. 18. This embodiment comprises display 12, controller 54, row signal generator 56, and a column signal generator 90.

Row signal generator 56 comprises Swift function generator 96 and plurality of row driver ICs $98_1$–$98_3$. Row signal generator 56 has been previously discussed in conjunction with FIG. 12; however, its operation is again described in conjunction with the operation of display system 10 in FIG. 18.

Column signal generator 90 comprises a column signal computer 200 and a plurality of column driver ICs $202_1$–$202_4$. Column signal computer 200 is electrically connected to controller 54 by data bus 58 and to ICs $202_1$–$202_4$ by output bus 208. It should be apparent to one skilled in the art that the actual number of ICs $202_1$–$202_4$ and $98_1$–$98_3$ depends on the number of rows and columns of display 12.

Control bus 62 electrically connects controller 54 with column signal computer 200 and drivers $202_1$–$202_4$. Output bus 97 connects Swift function generator 96 with column signal computer 200. Output bus 97 also connects Swift function generator 96 with row drivers $98_1$–$98_3$.

Figure 19:
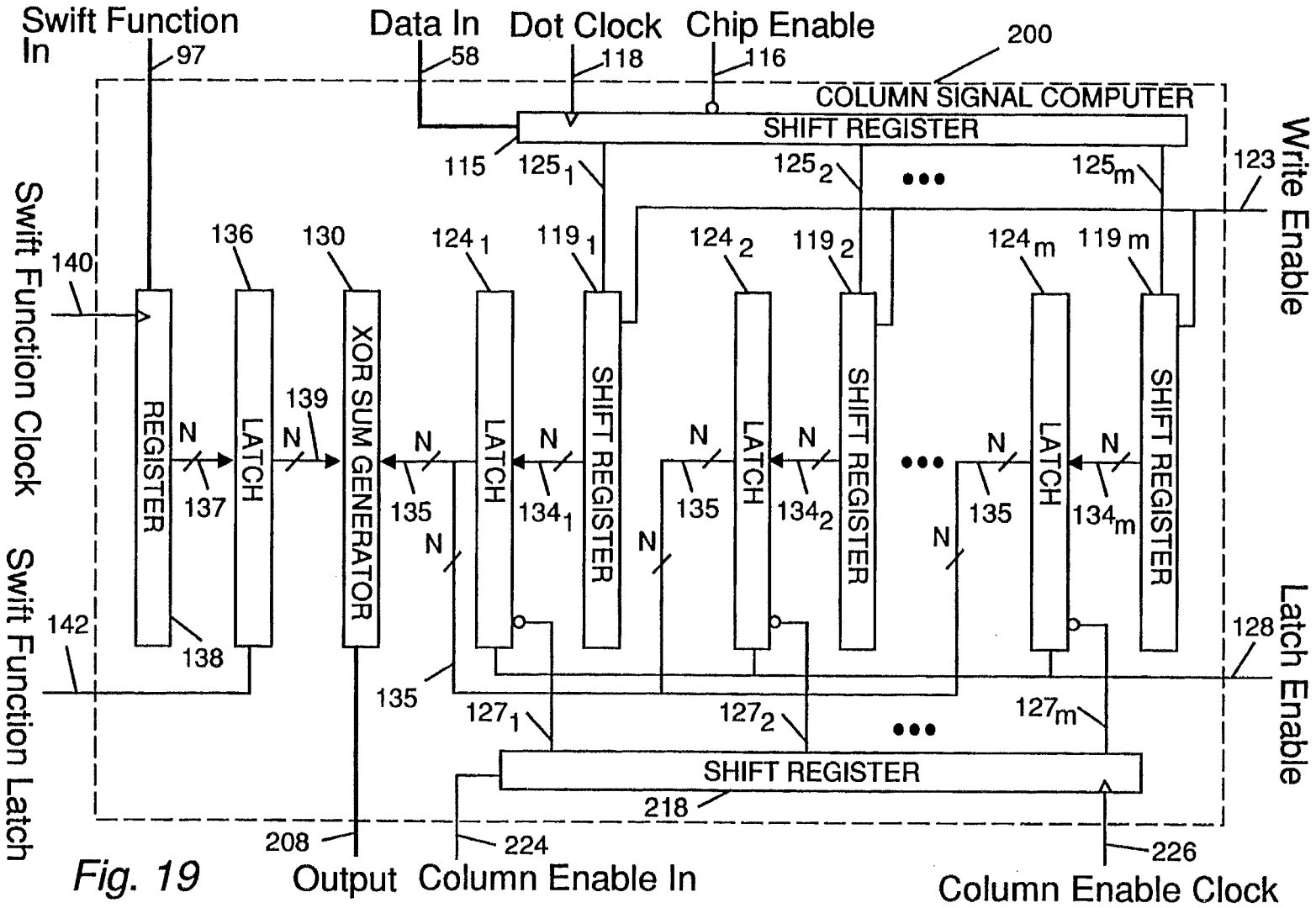
FIG. 19 is a block diagram showing the column signal computer of FIG. 18.

Referring now to FIG. 19, column signal computer 200 is shown in greater detail. As in the integrated driver embodiment 90 of FIGS. 12 and 14, column signal computer 200 comprises an m-element shift register 115 that receives formatted data from controller 54 via data bus 58. Preferably, register 115 is capable of receiving a complete line of M bits (i.e., m=M where M is the number of column electrodes $24_1$–$24_M$ of display 12) of formatted data. Data are transferred at a rate determined by the signal on clock line 118. A chip enable control line 116 provides the capability to interface multiple column signal computers 200 with controller 54 and display 12.

Column signal computer 200 also has a Swift function vector register 138 coupled to a latch 136 via bus 137. A Swift function vector $S(\Delta t_k)$ is shifted into register 138 via output bus 97 at a rate determined by the Swift function clock on line 140. As noted above, once a complete Swift function vector $S(\Delta t_k)$ has been shifted into register 138, its contents are shifted in parallel to latch 136 in response to a latch clock signal on control line 142. The outputs of latch 136 are connected to one set of inputs of XOR sum generator 130 via bus 139.

Column signal computer 200 further comprises a plurality of shift registers $119_1$–$119_m$ electrically connected to shift register 115 via connections $125_1$–$125_m$. The contents of shift register 115 are transferred in parallel to shift registers $119_1$–$119_m$ in response to a write enable signal provided by controller 54 on control line 123. Shift registers $119_1$–$119_m$ are filled from shift register 115 in the same manner as was described for the embodiment shown in FIGS. 12 and 14.

The outputs of shift registers $119_1$–$119_m$ are electrically connected to a plurality of latches $124_1$–$124_m$ via buses $134_1$–$134_m$. The contents of shift registers $119_1$–$119_m$ are transferred to latches $124_1$–$124_m$ in response to a latch enable signal provided by controller 54 on control line 128. As was the case for the embodiment shown in FIGS. 12 and 14, this transfer is effected by controller 54 when shift registers $119_1$–$119_m$ are full with one frame (or partial frame if m<M) of information vectors $I_1$–$I_m$.

The N outputs of latches $124_1$–$124_m$ are electrically connected to a bus 135 having N lines where each line connects the N outputs of latches $124_1$–$124_m$ to a corresponding one of N inputs of exclusive-or (XOR) sum generator 130. The XOR sum generator 130 has a second set of N inputs connected to corresponding outputs of latch 136. As in the previous embodiments, latch 136 provides the Swift function vector $S(\Delta t_k)$ to XOR sum generator 130 to enable generation column signals $30_1$–$30_m$ having amplitudes of $G_{I_1}(\Delta t_k)$ through $G_{I_m}(\Delta t_k)$, respectively.

An m-element column enable shift register 218, connected to latches $124_1$–$124_m$ via connections $127_1$–$127_m$, is used to sequentially enable the N outputs of latches $124_1$–$124_m$. A pulse provided on column enable in line 224 by the controller 54 in conjunction with a clock pulse on column enable clock line 226, also provided by controller 54, shifts an enable pulse into the first element of shift register 218. This enable pulse releases the contents of the first latch $124_1$ to bus 135, thus providing XOR sum generator 130 with information vector $I_1$ of enabled latch $124_1$. The absence of an enable pulse in the remaining elements of shift register 218 forces the outputs of latches $124_2$–$124_m$ to be in a high impedance state. Subsequent clock pulses on column enable clock line 226 provided by the controller 54 shift the enable pulse sequentially through the shift register 218, enabling the latches $124_2$–$124_m$ and sequentially providing all column information vectors $I_1$–$I_m$ to XOR sum generator 130.

When information vector $I_j$ (j=1, for example) is provided, XOR sum generator 130 uses information vector $I_j$ in conjunction with the current Swift function vector $S(\Delta t_k)$ provided by latch 136 to generate column signal $\mathbf{30}_j$ of amplitude $G_{I_j}(\Delta t_k)$ as described above. Column signal $\mathbf{30}_j$ is output on output bus 208. Column signal $\mathbf{30}_j$ is released to column drivers $\mathbf{202}_1$–$\mathbf{202}_4$, which stores the amplitude $G_{I_j}(\Delta t_k)$ of column signal $\mathbf{30}_j$ in a shift register internal (not shown) to column drivers $\mathbf{202}_1$–$\mathbf{202}_4$ in response to control signals generated by controller 54.

As column information vectors $I_2$–$I_m$ are provided to XOR sum generator 130, new column signals $\mathbf{30}_2$–$\mathbf{30}_m$ are generated and released to column drivers $\mathbf{202}_1$–$\mathbf{202}_4$ where each column signal $\mathbf{30}_2$–$\mathbf{30}_m$ is stored in the internal shift register (not shown) of column drivers $\mathbf{202}_1$–$\mathbf{202}_4$. When all m latches $\mathbf{124}_1\mathbf{124}_m$ have been enabled by shift register 218 and hence all m information vectors $I_1$–$I_m$ stored in latches $\mathbf{124}_1$–$\mathbf{124}_m$ have been provided to XOR sum generator 130, the m column signals $\mathbf{30}_1$–$\mathbf{30}_m$ having amplitude $G_{I_1}(\Delta t_k)$–$G_{I_m}(\Delta t_k)$, respectively, will have been generated and released to column drivers $\mathbf{202}_1$–$\mathbf{202}_4$. At this point, the column drivers $\mathbf{202}_1$–$\mathbf{202}_4$ simultaneously apply all m column signals $\mathbf{30}_1$–$\mathbf{30}_m$ to column electrodes $\mathbf{24}_1$–$\mathbf{24}_m$ of the display 12 in response to a control signal from controller 54 for the duration of time interval $\Delta t_{k+1}$. Substantially simultaneous with the application of the column signals $\mathbf{30}_1$–$\mathbf{30}_m$ to column electrodes $\mathbf{24}_1$–$\mathbf{24}_m$, the Swift function vector $S(\Delta t_k)$ is applied to the row electrodes $\mathbf{22}_1$–$\mathbf{22}_N$ by row drivers $\mathbf{98}_1\mathbf{98}_3$.

While column signals $\mathbf{30}_1$–$\mathbf{30}_m$ are being generated as described above for time interval $\Delta t_k$, a new Swift function vector $S(\Delta t_{k+1})$ is shifted into latch 138 in response to input signals provided by the Swift function generator 96 on Swift function output bus 97 and clock pulses on Swift function clock line 140. After column signals $\mathbf{30}_1$–$\mathbf{30}_m$ have been generated and applied to the column electrodes $\mathbf{24}_1$–$\mathbf{24}_m$, the new Swift function vector $S(\Delta t_{k+1})$ is transferred from register 138 to latch 136 in response to a pulse on Swift function latch line 142 and the process of generating and applying column signals $\mathbf{30}_1$–$\mathbf{30}_m$ each having an amplitude of $G_{I_1}(\Delta t_{k+1})$ through $G_{I_m}(\Delta t_{k+1})$ for time interval $\Delta t_{k+1}$ is repeated as described above.

The above process is repeated for all $2^s$ time intervals of the frame period, at which point a new frame of information vectors $I_1$–$I_m$ is transferred from shift registers $\mathbf{119}_1$–$\mathbf{119}_m$ to latches $\mathbf{124}_1$–$\mathbf{124}_m$, and the entire process is repeated.

Additional Enhancements of the Various Embodiments of the Present Invention

Gray Scale Shading:

Additional embodiments of the present invention allow for addressing individual pixels to include intermediate optical states between the "on" and "off" state. In this way, different gray shades or hues may be displayed.

A first gray scale method for addressing display 12 uses a technique known as frame modulation, where several frame periods T of display information are used to control the duration of time that a pixel is "on" compared with the time a pixel is "off". In this manner, a pixel may be addressed to an intermediate optical state. For example, four frame periods may be used during which a pixel is "on" for two periods and "off" for the other two periods. If the time constant of the panel is long compared to several frame periods, then the pixel will assume an average intermediate optical state between fully "on" and fully "off". With the frame modulation method, the various embodiments of the present invention require no modification. Rather, the external video source must be capable of providing the proper on/off sequence for each pixel within the several frame periods so as to cause the pixels to be in the desired optical state.

If the time constant ($\tau$) of display 12 is short compared to several frame periods T, the frame modulation method may be improved by decreasing the duration of the frame period T so as to increase the frame rate.

Figure 20:
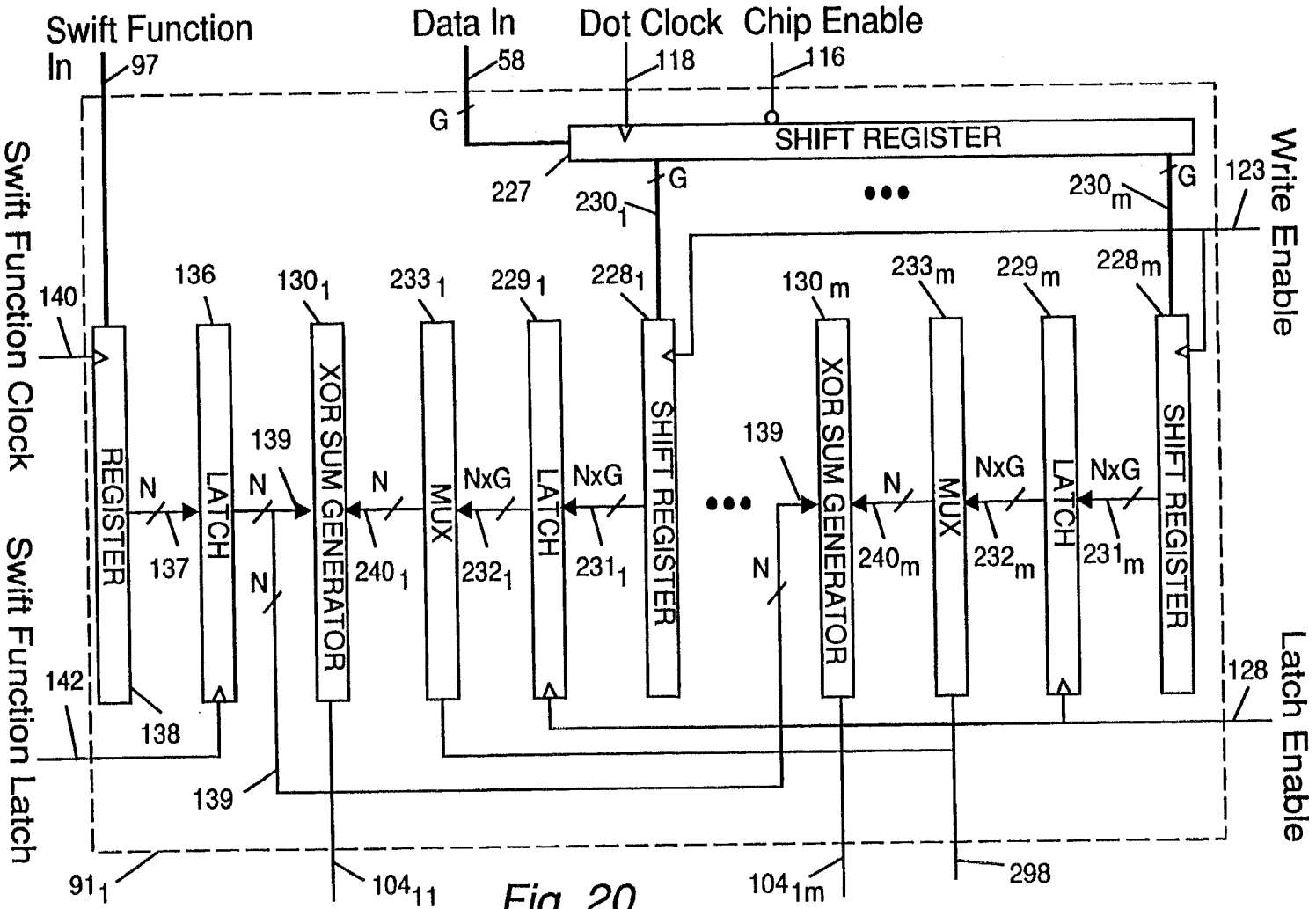
FIG. 20 is a block diagram showing an embodiment of the present invention of FIG. 14 incorporating gray shading.

Referring now to FIG. 20, another gray scale embodiment is shown which uses a technique known as a pulse width modulation, In the embodiments described up to this point, the information state of a pixel is either "on" or "off", and the information states of the pixels are represented by the elements of information vectors $I_1$–$I_m$ as single bit words. However, in the present gray scale embodiment, the information state of a pixel may not only be "on" or "off", but may be a multitude of intermediate levels or shades between "on" and "off". The information states of the pixels in the present embodiment are therefore represented by elements of information vector $I_1$–$I_m$ as multi-bit words indicating the states of the pixels. Implementing the present embodiment requires that each storage element in storage means 52 (FIG. 10) be expanded from single bit words to multi-bit words of depth G. In typical applications, G will be between 2 and 8 and the number of displayed levels is $2^G$, including "on" and "off". It should be understood the notation $I_j$ when used in describing the gray scale embodiments includes all G bits of the multi-bit word. Additionally, the notation $I_{jg}$ refers to $g^{th}$ plane of bits of information vector $I_j$.

In the present embodiment, each time interval $\Delta t_k$ is subdivided into G smaller time intervals $\Delta t_{kg}$ of equal or differing duration, where the sum of the durations of subintervals $\Delta t_{k1}$ through $\Delta t_{kG}$ is the same as the duration of time interval $\Delta t_k$. Column signals $\mathbf{30}_{1g}$–$\mathbf{30}_{mg}$ are generated for each time subinterval $\Delta t_{kg}$ (where g=1 to G). In the preferred embodiment, the duration of $\Delta t_{kg}$ is approximately half the duration of $\Delta t_{kg+1}$.

For any particular column (for instance j=7), column signal $\mathbf{30}_{71}$ during time subinterval $\Delta t_{k1}$ is generated using information vector $I_{71}$ obtained by considering only the least significant bits of the multi-bit words of information vector $I_7$. The next column signal $\mathbf{30}_{72}$ is generated using information vector $I_{72}$ obtained by considering only the second to the least significant bits of the multi-bit words of information vector $I_7$ during time subinterval $\Delta t_{k2}$. Subsequent column signals $\mathbf{30}_{7g}$–$\mathbf{30}_{7G}$ are similarly generated until all G column signals $\mathbf{30}_{71}$–$\mathbf{30}_{7G}$ have been generated.

The present embodiment is similar to the embodiment shown in FIG. 14. The differences being that the single bit storage element of shift register 227, shift registers $\mathbf{228}_1$–$\mathbf{228}_m$, and latches $\mathbf{229}_1$–$\mathbf{229}_m$ are expanded to multi-bit word storage elements of depth G, and a plurality of N-element 1-of-G multiplexers $\mathbf{233}_1$–$\mathbf{233}_m$ are added.

Operation of the present embodiment parallels that of the embodiment of FIG. 14 except that the display data are multi-bit words stored in a N×m×G information matrix I. Shift registers $\mathbf{228}_1$–$\mathbf{228}_m$ are filled in the manner described above and the contents are transferred to latches $\mathbf{229}_1$–$\mathbf{229}_m$. Likewise, Swift function vectors $S(\Delta t_k)$ are shifted into register 138 and then transferred into latch 136.

Once information vectors $I_1$–$I_m$ are transferred to latches $\mathbf{229}_1$–$\mathbf{229}_m$ in each of the G planes, multiplexers $\mathbf{233}_1$–$\mathbf{233}_m$, in response to a control signal provided by controller 54 on gray shade select line 298, sequentially present the G bits of column information vectors $I_1$–$I_m$ to XOR sum generators $130_1$–$130_m$, starting with the least significant bits during the time subinterval $\Delta t_{k1}$ and ending with the most significant bits G during time subinterval $\Delta t_k G$. In this way, G column signals $30^{j1}$–$30_{jG}$ having amplitudes of $G_{I_{j1}}(\Delta t_{k1})$–$G_{I_{jG}}(\Delta t_k G)$ are generated for each column electrode $24_j$ (j=%1 to m).

Figure 21:
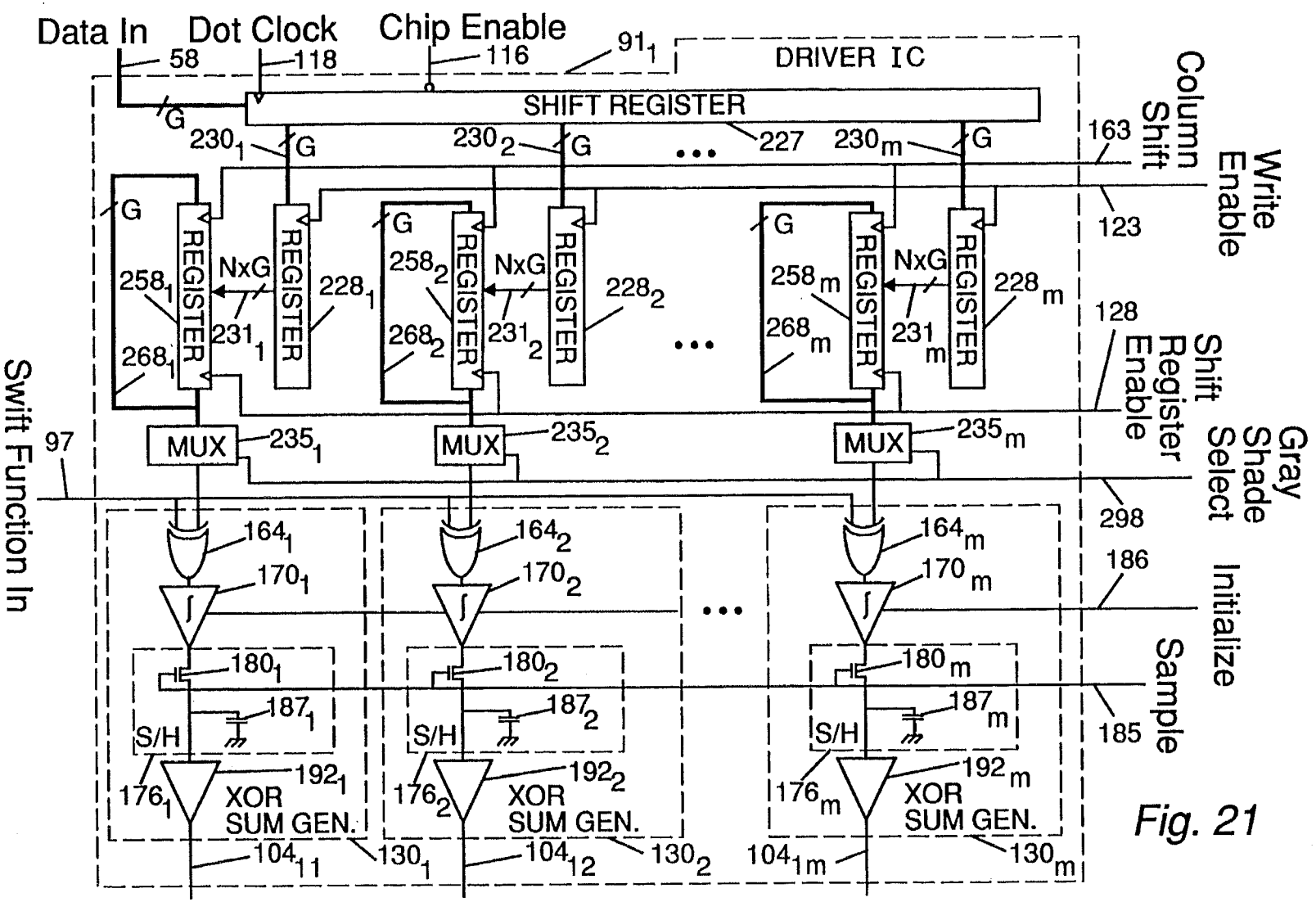
FIG. 21 is a block diagram showing an embodiment of the present invention of FIG. 17 incorporating gray shading.

Similar expansions of the embodiments shown in FIGS. 17 and 19 may be implemented to provide pulse width modulated intermediate or gray scale shading. FIG. 21 shows an expansion of the embodiment of FIG. 17 that provides pulse width modulated intermediate shades. Registers $228_1$–$228_m$ and $258_1$–$258_m$ have been expanded from single bit to order G, and N-element 1-of-G multiplexers $235_1$–$235_m$ have been added to select the proper significant bits of column information vectors $I_1$–$I_m$.

Figure 22:
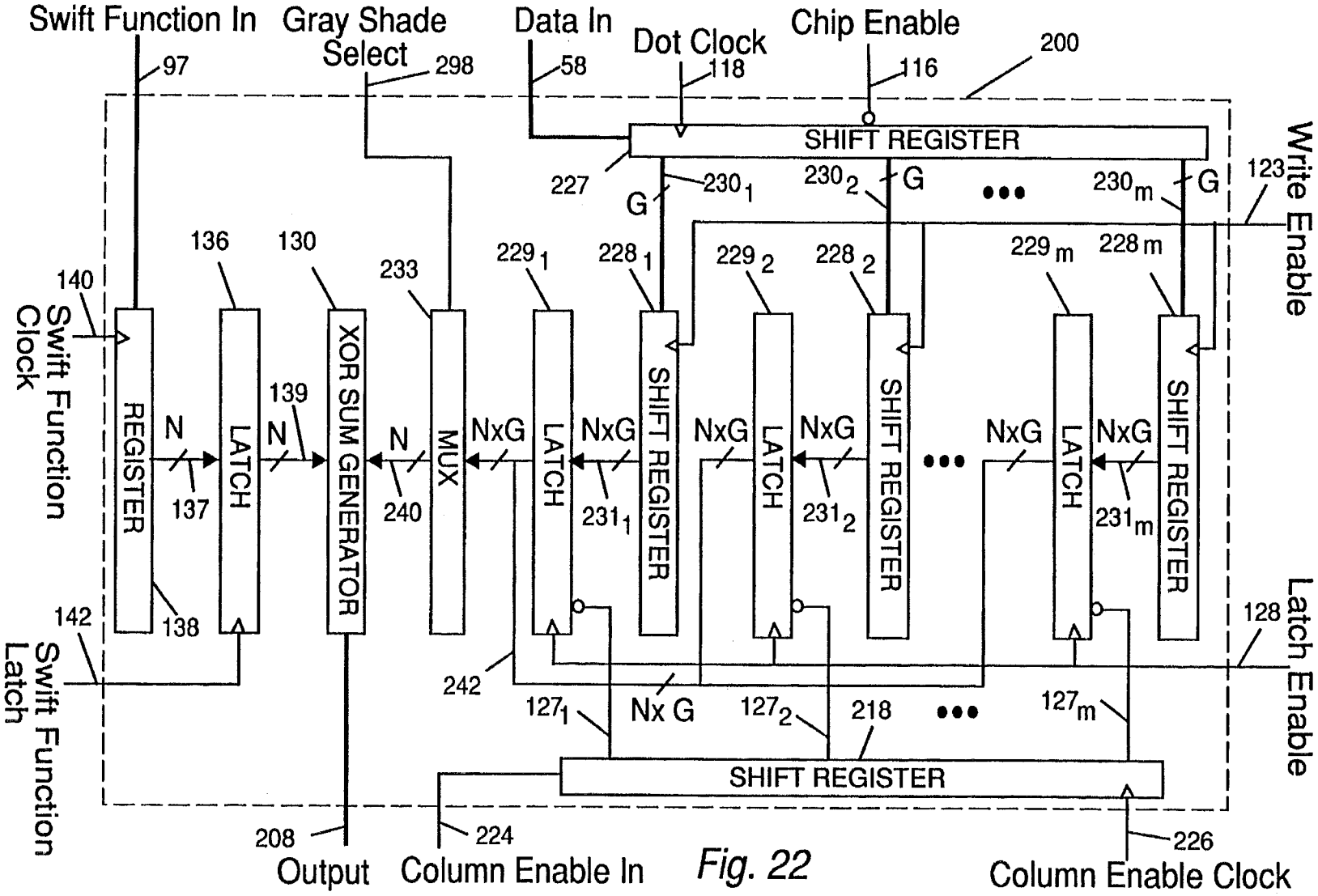
FIG. 22 is a block diagram showing an embodiment of the present invention of FIG. 19 incorporating gray shading.

FIG. 22 shows an embodiment similar to the embodiment of FIG. 19 that provides pulse width modulated capabilities for the display of intermediate shades. In this embodiment, a m×G-element shift register 227 receives formatted video data from bus 58. As described above, the elements of register 227 are transferred to a plurality of N×G shift registers $228_1$–$228_m$ via buses $230_1$–$230_m$. Buses $230_1$–$230_m$ are each one bit wide by G bits deep so that the contents of register 227 are transferred in parallel. The outputs of shift registers $228_1$–$228_m$ are electrically connected to a plurality of latches $229_1$–$229_m$ via buses $231_1$–$231_m$.

The N outputs of latches $229_1$–$229_m$ are electrically connected to a bus 242 having a width of N and a depth of G so that each outputs of latches $229_1$–$229_m$ is connected to an N-element 1-of-G multiplexer 233. Multiplexer 233 selects the proper significant bits (or plane) of column information vectors $I_1$–$I_m$. The remainder of the operation is similar to that described above for FIG. 19.

The frame modulation and pulse width modulation methods may be advantageously combined to provide an even greater number of distinct intermediate optical states of pixels 26 of display system 10.

Figure 23:
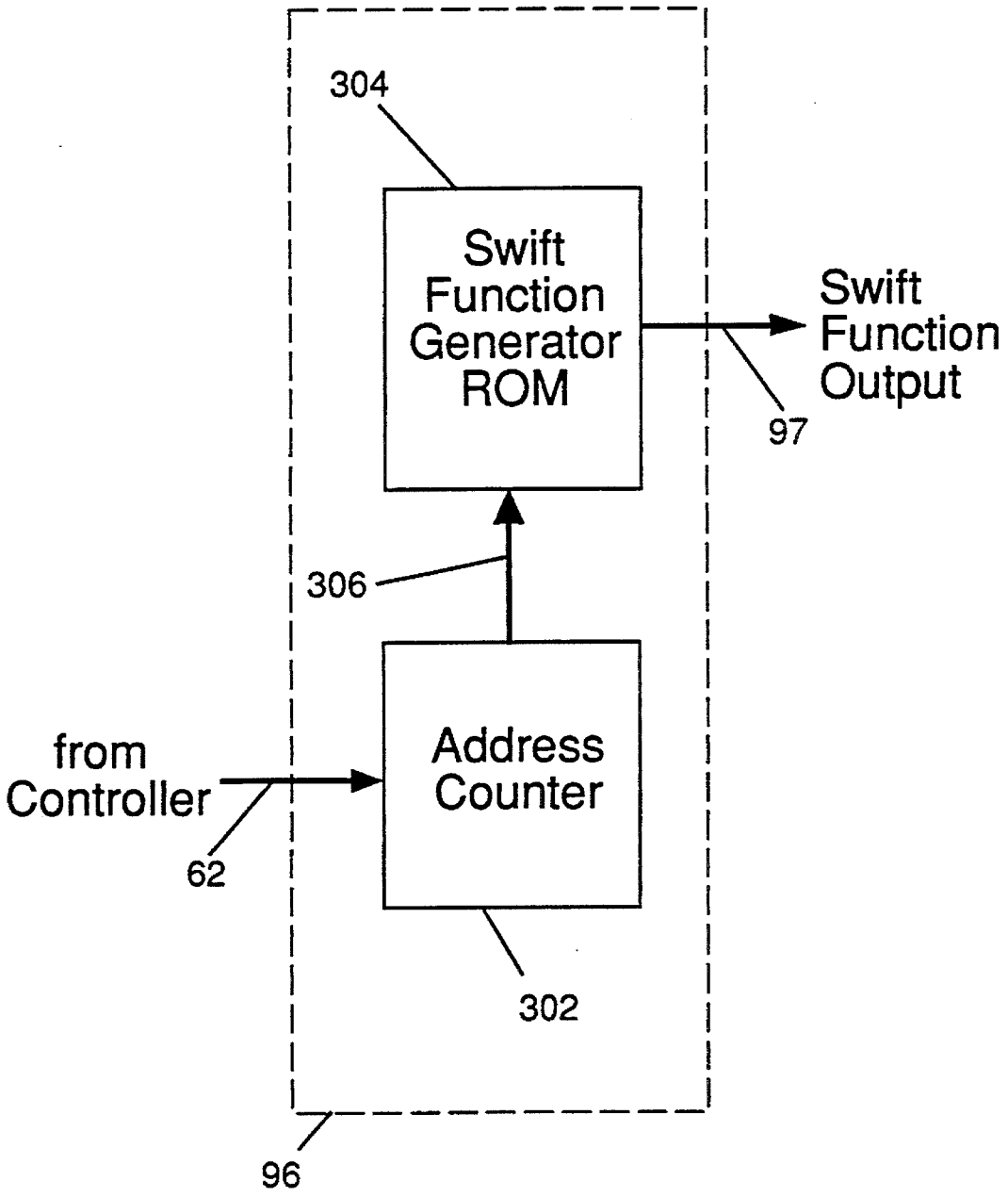
FIG. 23 is a block diagram of one embodiment of the Swift function generator shown in FIG. 18.
Figure 24:
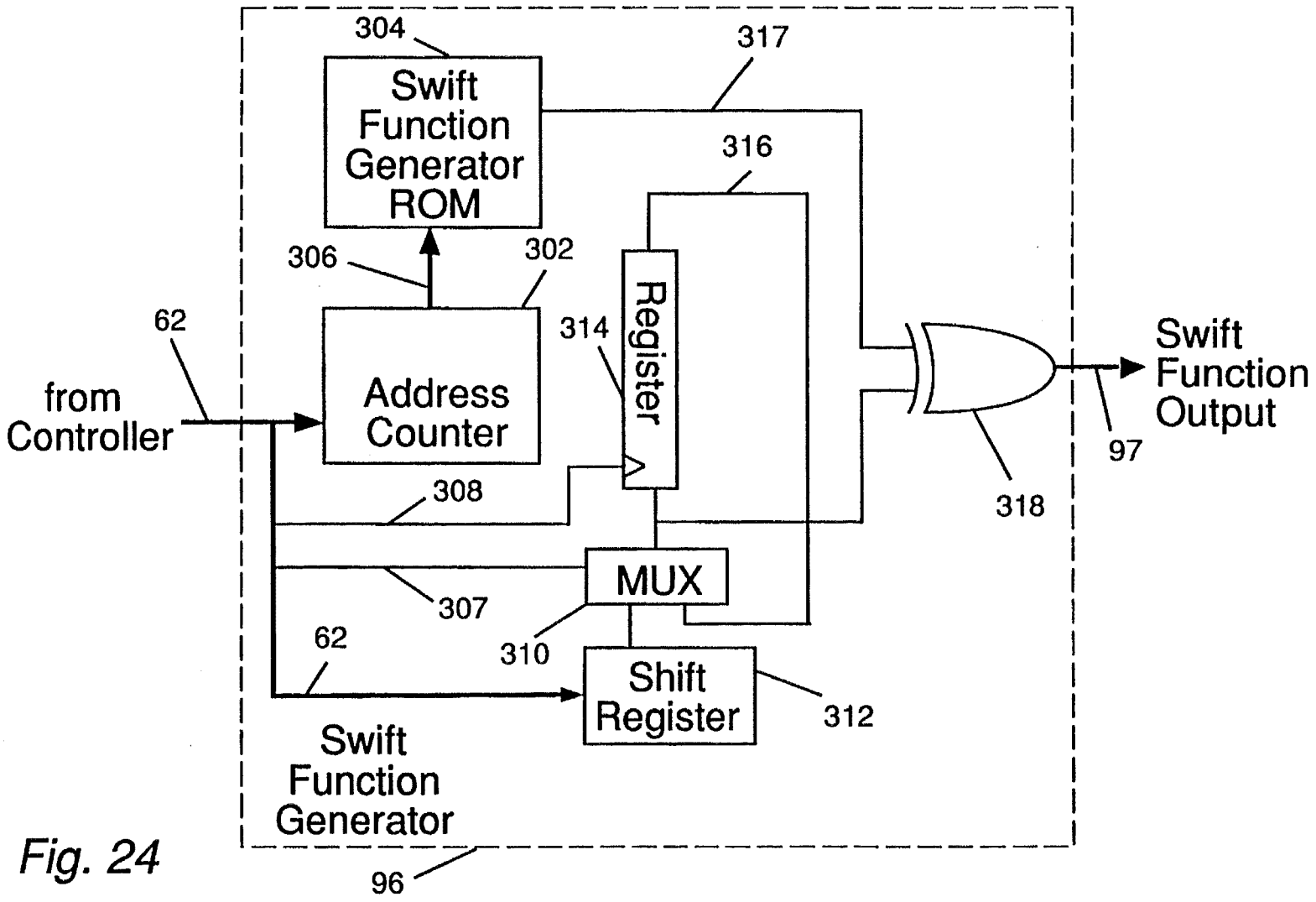
FIG. 24 is a block diagram of a second embodiment of the Swift function generator which provides random inversion of the Swift functions.
Figure 25:
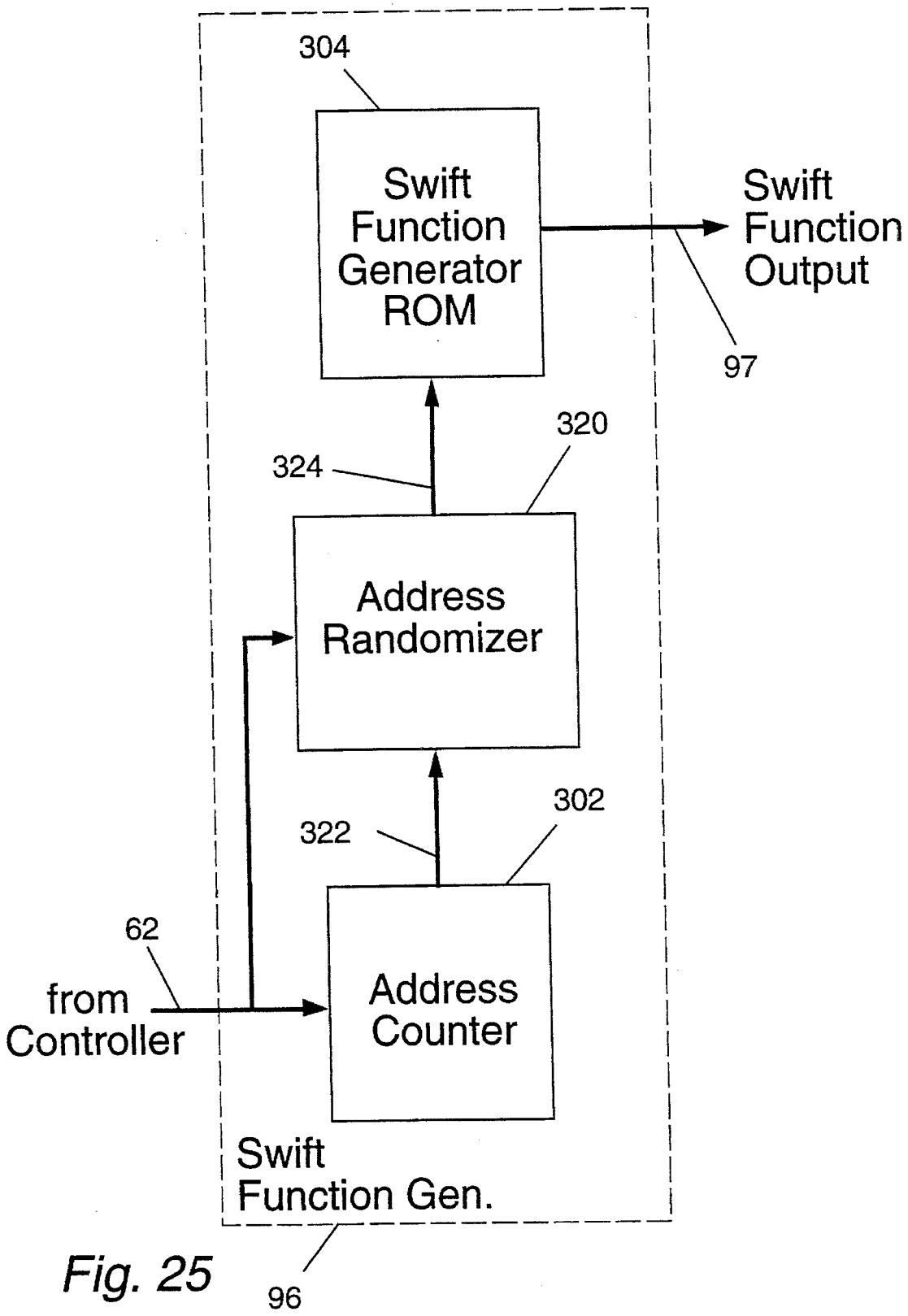
FIG. 25 is a block diagram of a third embodiment of the Swift function generator which provides random reordering of the Swift functions.

Swift Function Generator Embodiments:

Referring now to FIGS. 23–25, various embodiments of Swift function vector generator 96 of FIGS. 12 and 18 are suggested.

One basic embodiment, shown in FIG. 23, for Swift function generator 96 may comprise an address counter 302 and a Swift function generator ROM 304 connected by a control and address bus 306. As discussed above, control bus 62 electrically connects controller 54 and Swift function generator 96 while output bus 97 routes the outgoing Swift function vector $S(\Delta t_k)$ to the appropriate circuits.

In the embodiment of FIG. 23, a matrix of Swift functions $S_i$ are stored in ROM 304. In response to control signals supplied by controller 54 on bus 62, Swift function vector $S(\Delta t_k)$ are selected by the address signals on bus 306. The selected Swift function vector $S(\Delta t_k)$ is read out of ROM 304 onto output bus 97.

As was noted above, it is often desirable to randomly invert some rows of the Swift function matrix S to prevent display data consisting of regular patterns from causing unusually high amplitude ($G_{I_j}(\Delta t_k)$) column signals $30_1$–$30_M$. Alternatively, it may be desirable to randomly reorder Swift functions $S_i$ to prevent streaking in the displayed image. Finally, it may be desirable to both randomly invert and randomly reorder the Swift functions $S_i$ for the best performance.

FIG. 24 shows another preferred embodiment of Swift function generator 96 which randomly inverts Swift functions $S_i$. Controller 54 provides control signals on control bus 62 and more specifically on control line 307 and clock line 308 to a multiplexer 310, a random (or pseudo-random) generator 312 and an N-element shift register 314. Random generator 312 generates a random N-bit sequence of logic ones and logic zeros which are routed to a first input of multiplexer 310. Multiplexer 310, in response to control signals on control line 307, selects the input connected to generator 312 so that the random sequence of bits are shifted into register 314 in response to a clock signal on clock line 308. When register 314 is full, multiplexer 310 selects the input connected to the output of register 314 by bus 316. A new bit pattern is preferably provided from generator 312 for each frame period T.

The first element of register 314 is clocked out and provided to the first input of a two-input XOR gate 318. The output from register 314 is also recirculated back into register 314 through multiplexer 310 so that the random bit pattern is maintained for an entire frame period.

Each element stored in register 314 corresponds to one element of the Swift function vector $S(\Delta t_k)$ and is clocked, element by element, to the second input of XOR gate 318. The logical combination of corresponding elements from register 312 and the Swift function vector $S(\Delta t_k)$ by XOR gate 318 either inverts the Swift functions $S_i$ or passes the Swift functions $S_i$ without inversion.

The embodiment of FIG. 24 has been described for the random inversion of Swift function vectors $S(\Delta t)$ that are transmitted on output bus 97 in a serial manner. However, one skilled in the art may expand the present embodiment by providing additional planes of circuitry by duplicating elements 310, 312, 314 and 318. In this manner, a plurality of Swift function vector $S(\Delta t)$ bits may be inverted and transmitted in parallel.

Referring now to FIG. 25 a further embodiment for the Swift function generator 96 is shown that randomly (or pseudo-randomly) changes the order of the Swift functions $S_i$ of matrix 40. Depending on the type of Swift functions used, it may be desirable to randomize the order every few frame periods. Preferably it is desireable to randomize the order every frame period T.

The order is changed by an address randomizer 320 that remaps the address supplied from address counter 302 every frame period T. In this manner, the order in which the Swift functions $S_i$ are selected may be randomly changed. Address randomizer 320 is connected to address counter 302 by bus 322 and to ROM 304 by bus 324.

In another embodiment (not shown), the embodiments of FIGS. 24 and 25 are combined in a single circuit.

It should be apparent that the invention may be embodied in other specific forms without departing from its spirit or essential characteristics. Liquid crystal displays, for example, form only part of the broader category of liquid crystal electro-optical devices, such as print heads for hard copy devices and spatial filters for optical computing, to which this invention could be applied. The described embodiments are to be considered in all respects only as illustrated and not restrictive and the scope of the invention is, therefore, indicated by the appended claims.

What is claimed is:

1. A method for addressing a display including overlapping first and second electrodes positioned on opposite sides of an rms-responding material to define an array of pixels that display arbitrary information patterns characterized by optical states that depend on values of rms voltages established across the pixels and corresponding to pixel input data, the method comprising:

applying a set of first signals to corresponding first electrodes during a frame period that is divided into time intervals, the first signals having amplitudes, and multiple ones of the first signals each causing multiple selections of the corresponding first electrodes, the multiple selections taking place during different ones of the time intervals and being distributed over the frame period;

each of the first signals provides a number of the time intervals over the frame period that is less than an exponential function of the number of first electrodes;

generating second signals and applying them to the second electrodes, each of the second signals being different from any of the first signals, and the second signals having at a particular time interval during the frame period amplitudes determined by both the amplitudes of the first signals causing selections at the particular time interval and the corresponding pixel input data; and the amplitudes of multiple second signals being determined by contributions of the multiple selections by each one of the first signals in the set that are distributed over the frame period so as to reduce the frame response of the display.

2. The method of claim 1 wherein the amplitude of each one of the second signals is proportional to a sum of products of the amplitudes of the first signals causing selections and the pixel input data of pixels defined by the corresponding first electrodes, and the proportionality constant is about $1/\sqrt{N}$, where N is the number of first electrodes.

3. The method of claim 1 wherein all of the first signals cause multiple selections of the corresponding first electrodes the multiple selections being distributed over the frame period.

4. The method of claim 1 wherein multiple ones of the first signals have rms values that are normalized to a common value.

5. The method of claim 1 wherein the first signals are orthogonal to one another.

6. A system for addressing an rms-responding display of a type that displays arbitrary information patterns, the display including overlapping first and second electrodes positioned on opposite sides of an rms-responding material to define an array of pixels that display arbitrary information patterns corresponding to pixel input data, the system comprising:

a first signal generator for generating and applying a set of first signals to corresponding first electrodes during a frame period, the first signals having amplitudes, and each one of the first signals in the set causing multiple selections of its corresponding first electrode, the multiple selections being distributed over the frame period;

storage sites for storing the pixel input data; and a second signal generator for generating second signals and output connection means for applying the second signals to the second electrodes, the second signal generator including a correlator for correlating the first signals and the stored pixel input data to determine the second signals so that contributions of the multiple selections by each one of the first signals in the set to determinations of amplitudes of multiple second signals are distributed over the frame period, the correlator including data transfer signal means for writing into and reading from the storage sites sets of pixel input data, each of the sets of pixel input data corresponding to pixels defined by a different one of the second electrodes; multiplying means for multiplying the first signals and the sets of pixel input data to derive product signals; and summing means for summing the product signals derived for each set of pixel input data to produce the second signals for delivery to the output connection means.

7. The method of claim 1 wherein the amplitudes of at least some of the first signals include two nonzero signal levels to effect the multiple selections of the corresponding first electrodes.

8. The method of claim 1 wherein each of the first signals is derived from an orthonormal function matrix having a set order of $2^s$, where S is a positive integer and the display includes a number of first electrodes which number is greater than $2^{s-1}$ and less than or equal to $2^s$.

9. The method of claim 8 wherein the first signals are derived from a set of Walsh functions.

10. The method of claim 9 wherein the set of Walsh functions is sequency ordered.

11. The method of claim 10 wherein the sequency-ordered set of Walsh functions is of the highest sequency.

12. A system for addressing rms-responding information storage elements that store arbitrary information patterns, the system including overlapping first and second electrodes positioned on opposite sides of an rms-responding material to define an array of information storage elements that store arbitrary information patterns corresponding to information input data, the system comprising:

a first signal generator for generating and applying a set of first signals to corresponding first electrodes during a frame period, the first signals having amplitudes, and the amplitude of each one of the first signals in the set including two nonzero signal levels causing multiple selections of its corresponding first electrode, the multiple selections being distributed over the frame period;

storage sites for storing the information input data;

a second signal generator for generating second signals, the second signal generator including a correlator for correlating the first signals and the stored information input data to determine the second signals, and each of the second signals having at a particular time during the frame period an amplitude determined by the amplitudes of more than one of the first signals causing selections at the particular time and by information input data of information storage elements defined by the corresponding first electrodes so that contributions of the multiple selections by each one of the first signals in the set to determinations of amplitudes of multiple second signals are distributed over the frame period and so as to address an arbitrary number of information storage elements; and output connection means for applying the second signals to the second electrodes.

13. The method of claim 12 wherein an additional vector is added to the set of Pseudo Random Binary Sequence functions, all elements of the additional vector having a value of +1 so that each first signal is orthogonal to the other first signals and that the rms-responding material is free of net dc voltages.

14. The method of claim 1 wherein the second signals applied to the second electrodes are selected from a reduced set of possible signal levels and the amplitudes of the second signals are selected so as to correspond to the nearest one of the levels.

15. The method of claim 14 wherein the reduced set has maximum and minimum levels and the second signals exceeding the maximum or minimum level of the reduced set are clipped.

16. The method of claim 1 wherein the amplitude of each one of the second signals is proportional to a sum of products of the amplitudes of the first signals causing selections and the pixel input data of pixels defined by the corresponding first electrodes.

17. The method of claim 1, further comprising applying to the corresponding first electrodes the multiple ones of the first signals in an arrangement that reduces anomalous display effects.

18. The method of claim 1, further comprising inverting the amplitudes of a certain proportion of the first signals to reduce the maximum amplitudes of the second signals.

19. The method of claim 18 wherein the certain proportion of inverted first signals is between about 40% and 60% of all of the first signals.

20. The method of claim 1 wherein the amplitudes of the first signals the amplitudes of the first signals have in a time order discrete values associated with each of the time intervals, the method further comprising arranging the time order of the amplitude values of the first signals to reduce crosstalk among the pixels in the array.

21. The method of claim 1 wherein there are N number of first electrodes and the frame period is divided into $2^s$ or fewer time intervals, where $2^{s-1}<N\leqq 2^s$.

22. The method of claim 1 wherein the rms-responding material includes a liquid crystal material.

23. The method of claim 1 wherein the display is of a high information content type.

24. The method of claim 1 wherein the first signals are derived from a set of pseudo random functions.

25. The method of claim 1 wherein the rms-responding display is of a supertwist liquid crystal type.

26. An apparatus for addressing an rms-responding, high information content liquid crystal display in which a first set of electrodes arranged in a first electrode pattern and a second set of electrodes arranged in a second electrode pattern overlapping each other to define an array of pixels that display arbitrary information patterns corresponding to pixel input logic levels, the apparatus comprising:

means for driving the first set of electrodes with first signals, each first signal having an amplitude, including a periodic train of pulses, and having a common frame period; and means for driving each electrode of the second set of electrodes with a second signal that is proportional to a sum of exclusive-or (XOR) products of the pixel input logic levels and logic levels representative of the amplitudes of the first signals applied to the first electrodes.

whereby the first and second signals establish across each pixel a peak voltage and an rms voltage, and the absolute value of the peak voltage across any pixel is no more than 5 times the rms voltage across the pixel averaged over one frame period.

27. The apparatus of claim 26 wherein the absolute value of the peak voltage across any pixel is no more than 3 times the rms voltage across the pixel averaged over one frame period.

28. The apparatus of claim 26 wherein the periodic train of pulses of each first signal includes two nonzero voltage levels.

29. The apparatus of claim 26 wherein the liquid crystal display is of a supertwist type.

30. A high information content, direct multiplexed, rms-responding display system that displays arbitrary information patterns in successive frame periods, comprising:

a liquid crystal display having first and second substrates, the first substrate having a first electrode pattern on an inner first surface and the second substrate having a second electrode pattern on an inner second surface; the first and second substrates disposed so as to form a narrow gap enclosed by a seal; a low viscosity liquid crystal material disposed in the gap between the first and second surfaces wherein a plurality of fast responding pixels are formed wherever the first and second electrode patterns overlap; the liquid crystal display having an optical switching response time constant of less than 200 ms; and means for providing an electrical signal to each of the electrode patterns to apply a voltage across and thereby selectively control an optical state of each pixel, where the electrical signals applied to the electrode patterns establish across each pixel peak voltage and rms voltage amplitudes, and the ratio of the absolute value of the peak voltage amplitude to the rms voltage amplitude across each pixel is less than 7:1 averaged over one frame period.

31. The display system of claim 30 wherein the ratio of the absolute value of the peak voltage amplitude to the rms voltage amplitude across each pixel is less than 5:1 averaged over one frame period.

32. The display system of claim 30 wherein the ratio of the absolute value of the peak voltage amplitude to the rms voltage amplitude across each pixel is less than 3:1 averaged over one frame period.

33. The display system of claim 30 wherein the liquid crystal display has a time constant of less than 50 ms.

34. The display system of claim 30 wherein the liquid crystal display is of a supertwist type.

35. A method for addressing an rms-responding, high information content display of a type that displays arbitrary information patterns in successive frame periods, the display including overlapping first and second electrodes positioned on opposite sides of an rms-responding material to define an array of pixels that display arbitrary information patterns corresponding to pixel input data, the method comprising:

applying a first signal to each first electrode, each of the first signals having an amplitude and a common frame period divided into time intervals, the amplitudes of the first signals having discrete values associated with each of the time intervals, and no more than a certain proportion equal to about 75% of the first signals having substantially the same amplitude for any given time interval; and generating second signals and applying them to the second electrodes, each of the second signals having at a particular time during the frame period an amplitude determined by the amplitudes of more than one of the first signals at the particular time and by pixel input data of pixels defined by the corresponding first electrodes.

36. The method of claim 35 wherein the certain proportion is equal to about 50% of all of the first signals for any given time interval.

37. The method of claim 35 wherein the amplitude of each one of the second signals is proportional to a sum of products of the amplitudes of the first signals and the pixel input data of pixels defined by the corresponding first electrodes.

38. The method of claim 37 wherein a proportionality constant relates the amplitude of each of the second signals to the sum of products of the amplitudes of the first signals and the pixel input data of pixels defined by the corresponding first electrodes, and the proportionality constant is about $1/\sqrt{N}$, where N is the number of first electrodes.

39. The method of claim 35 wherein the rms-responding material includes a liquid crystal material.

40. The method of claim 35 wherein the rms-responding display is of a supertwist liquid crystal type.

41. A method for addressing an rms-responding display of a type that displays arbitrary information patterns, the display including overlapping first and second electrodes positioned on opposite sides of an rms-responding material to define an array of pixels that display arbitrary information patterns corresponding to pixel input data, the method comprising:

applying first signals to corresponding first electrodes during a frame period that is divided into time intervals, the first signals having amplitudes, and multiple ones of the first signals causing multiple selections of the corresponding first electrodes, the multiple selections taking place during different ones of the time intervals and being distributed over the frame period to reduce the frame response of the display;

each of the first signals provides a number of the time intervals over the frame period that is less than an exponential function of the number of first electrodes; and generating a second signal of changing magnitude and applying it to one of the second electrodes, the second signal having at a particular time interval during the frame period an amplitude determined by both the amplitudes of more than one of the first signals causing selections at the particular time interval and the corresponding pixel input data.

42. The method of claim 41 wherein the amplitude of the second signal is proportional to a sum of products of the amplitudes of the first signals causing selections and the pixel input data of pixels defined by the corresponding first electrodes.

43. The method of claim 42 wherein a proportionality constant relates the amplitude of the second signal to the sum of products of the amplitudes of the first signals causing selections and the pixel input data of pixels defined by the corresponding first electrodes, and the proportionality constant is about $1/\sqrt{N}$, where N is the number of first electrodes.

44. The method of claim 41 wherein each of the first signals has an rms value that is normalized to a common value.

45. The method of claim 41 wherein the first signals are orthogonal to one another.

46. The method of claim 41 wherein the amplitudes of at least some of the first signals include two nonzero signal levels to effect the multiple selections of the corresponding first electrodes.

47. The method of claim 46 wherein the amplitude of the second signal is proportional to a sum of exclusive-or products of logic levels representative of the two nonzero signal levels of the first signals and logic levels representative of the pixel input data of pixels defined by the corresponding first electrodes.

48. The method of claim 41 wherein each of the first signals is derived from an orthonormal function matrix having a set order of $2^s$, where S is a positive integer and the display includes a number of first electrodes which number is greater than $2^{s-1}$ and less than or equal to $2^s$.

49. The method of claim 48 wherein the first signals are derived from a set of Walsh functions.

50. The method of claim 41 wherein the first signals are derived from a set of pseudo random functions.

51. The method of claim 41 wherein the first signals are chosen from a set of $2^s-1$ maximal length Pseudo Random Binary Sequence functions, where S is a positive integer and the display includes a number of first electrodes which number is greater than $2^{s-1}$.

52. The method of claim 51 wherein an additional vector is added to the set of Pseudo Random Binary Sequence functions, all elements of the additional vector having a value of +1 so that each first signal is orthogonal to the other first signals and that the rms-responding material is free of net dc voltages.

53. The method of claim 41, further comprising applying to the corresponding first electrodes the multiple ones of the first signals in an arrangement that reduces anomalous display effects.

54. The method of claim 41, further comprising inverting the amplitudes of a certain proportion of the first signals to reduce the maximum amplitudes of the second signals.

55. The method of claim 41 wherein all of the first signals cause multiple selections of the corresponding first electrodes, the multiple selections being distributed over the frame period.

56. The method of claim 41 wherein the rms-responding display is of a supertwist liquid crystal type.

57. In an addressing structure of a type that addresses information storage elements that develop arbitrary information patterns corresponding to information input data, the structure including first and second electrodes operatively associated with an addressing material to define an array of information storage elements that develop arbitrary information patterns corresponding to the information input data, a method of addressing the addressing structure, comprising:

applying first signals to the first electrodes during a frame period that is divided into time intervals, the first signals having amplitudes, and multiple ones of the first signals causing multiple selections of the corresponding first electrodes, the multiple selections taking place during different ones of the time intervals and being distributed over the frame period to reduce the frame response of the addressing structure;

each of the first signals provides a number of the time intervals over the frame period that is less than an exponential function of the number of first electrodes; and generating a second signal of changing magnitude and applying it to one of the second electrodes, the second signal having at a particular time interval during the frame period an amplitude determined by both the amplitudes of more than one of the first signals causing selections at the particular time interval and the corresponding information input data.

58. The method of claim 57 wherein the amplitude of the second signal is proportional to a sum of products of the amplitudes of the first signals causing selections and the information input data of information storage elements defined by the corresponding first electrodes.

59. The method of claim 57 wherein the first signals are normalized to a common value.

60. The method of claim 57 wherein the first signals are orthogonal to one another.

61. The method of claim 57 wherein the amplitudes of at least some of the first signals include two nonzero signal levels to effect the multiple selections of the corresponding first electrodes.

62. The method of claim 61 wherein the amplitude of the second signal is proportional to a sum of exclusive-or products of logic levels representative of the two nonzero signal levels of the first signals and logic levels representative of the information input data of information storage elements defined by the corresponding first electrodes.

63. The method of claim 57 wherein each of the first signals is derived from an orthonormal function matrix having a set order of $2^s$, where S is a positive integer and the addressing structure includes a number of first electrodes which number is greater than $2^{s-1}$ and less than or equal to $2^s$.

64. The method of claim 63 wherein the first signals are derived from a set of Walsh functions.

65. The method of claim 64 wherein the set of Walsh functions is sequency-ordered.

66. The method of claim 65 wherein the sequency-ordered set of Walsh functions is of the highest sequency.

67. The method of claim 57 wherein the first signals are derived from a set of pseudo random functions.

68. The method of 57 wherein the first signals are chosen from a set of $2^s-1$ maximal length Pseudo Random Binary Sequence functions, where S is a positive integer and the addressing structure includes a number of first electrodes which number is greater than $2^{s-1}$.

69. The method of claim 68 wherein an additional vector is added to the set of Pseudo Random Binary Sequence functions, all elements of the additional vector having a value of +1 so that each first signal is orthogonal to the other first signals and that the rms-responding material is free of net dc voltages.

70. The method of claim 57 wherein all of the first signals cause multiple selections of the corresponding first electrodes, the multiple selections being distributed over the frame period.

71. The method of claim 57 wherein the addressing material includes an rms-responding material.

72. The method of claim 57, further comprising applying to the corresponding first electrodes the multiple ones of the first signals in an arrangement that reduces anomalous information storage effects.

73. The method of claim 57, further comprising inverting the amplitudes of a certain proportion of the first signals to reduce the maximum amplitudes of the second signals.

74. The method of claim 73 wherein the proportion of inverted first signals is between about 40% and 60% of all of the first signals.

75. The method of claim 57 wherein the amplitudes of the first signals have in a time order discrete values associated with each of the time intervals, the method further comprising arranging the time order of the amplitude values of the first signals to reduce crosstalk among the information storage elements in the array.

76. The method of claim 57 wherein there are N number of first electrodes and the frame period is divided into $2^s$ or fewer time intervals, where $2^{s-1}<N<2^s$.

77. A method for addressing an rms-responding display of a type that displays arbitrary information patterns, the display including overlapping first and second electrodes positioned on opposite sides of an rms-responding material to define an array of pixels that display arbitrary information patterns corresponding to pixel input data, the method comprising:

applying first signals to corresponding first electrodes during a frame period that is divided into time intervals, the first signals having amplitudes at least some of which include two nonzero signal levels to effect multiple selections of the corresponding first electrodes, and multiple ones of the first signals causing multiple selections of the corresponding first electrodes, the multiple selections taking place during different ones of the time intervals and being distributed over the frame period;

each of the first signals provides a number of the time intervals over the frame period that is less than an exponential function of the number of first electrodes; and generating second signals and applying them to the second electrodes, each of the second signals being different from any of the first signals, the second signals having at a particular time interval during the frame period amplitudes determined by both the amplitudes of the first signals at the particular time interval and the corresponding pixel input data, and the amplitude of each of the second signals being proportional to a sum of exclusive-or products of logic levels representative of the two nonzero signal levels of the first signals and logic levels representative of the pixel input data of pixels defined by the corresponding first electrodes; and the amplitudes of multiple second signals being determined by contributions of the multiple selections by each one of the first signals that are distributed over the frame period so as to reduce the frame response of the display.

78. The method of claim 77 wherein each sum of the logic levels representing all first signals for any time interval has a parity value and each sum of the logic levels of the pixel input data for any second electrode has a parity value, the first signals are chosen such that for all time intervals of the frame period the parity values are the same for each sum of the logic levels representing all first signals for any time interval, and the pixel input data of a designated first electrode are chosen such that the parity values are the same for each sum of the logic levels of the pixel input data for any second electrode.

79. The method of claim 78 wherein the display of the designated first electrode is suppressed.

* * * * *